US008621902B2

(12) United States Patent
Mathachan

(10) Patent No.: US 8,621,902 B2
(45) Date of Patent: Jan. 7, 2014

(54) MASTER KEYING SYSTEM AND METHOD FOR PROGRAMMABLE LOCK CYLINDER ASSEMBLIES

(75) Inventor: Sajil John Mathachan, Karnataka (IN)

(73) Assignee: Schlage Lock Company LLC, Indianapolis, IN (US)

( * ) Notice: Subject to any disclaimer, the term of this patent is extended or adjusted under 35 U.S.C. 154(b) by 565 days.

(21) Appl. No.: 12/474,804

(22) Filed: May 29, 2009

(65) Prior Publication Data

US 2009/0277239 A1 Nov. 12, 2009

Related U.S. Application Data

(63) Continuation-in-part of application No. 12/138,950, filed on Jun. 13, 2008.

(60) Provisional application No. 60/934,353, filed on Jun. 13, 2007.

(51) Int. Cl.
*E05B 27/04* (2006.01)
*E05B 29/04* (2006.01)

(52) U.S. Cl.
USPC ..... 70/492; 70/340; 70/384; 70/495

(58) Field of Classification Search
USPC ..... 70/337–343, 368, 382–385, 491–496
See application file for complete search history.

(56) References Cited

U.S. PATENT DOCUMENTS 1,494,765 A 5/1924 Barrett
1,514,318 A 11/1924 Henriksson
1,564,556 A 12/1925 Goodfellow
1,965,336 A 7/1934 Gerald
3,320,781 A 5/1967 Hill
3,499,302 A 3/1970 Spain et al.
3,589,153 A 6/1971 Hill (Continued)

FOREIGN PATENT DOCUMENTS

EP 0 226 252 6/1987
EP 1 752 601 2/2007

(Continued)

OTHER PUBLICATIONS

Chinese First Office Action issued for Application No. CN 200880019717.0 dated Feb. 29, 2012 with English translation.

(Continued)

*Primary Examiner* — Christopher Boswell
(74) *Attorney, Agent, or Firm* — RatnerPrestia

(57) ABSTRACT

A master key system and method for a reprogrammable lock cylinder with at least one first master pin and one second master pin. The first and second master pins have different bitting configurations. The master key system includes at least a first array of change key cuts corresponding to an input key bitting array and sequence of progression and at least two master key cuts corresponding to the input key bitting array and sequence of progression and each of the change key cuts. The system further comprises at least one master pin matrix including a master pin sequence for each change key cut and at least one rekey matrix including a rekey cut for each change key. Each master pin sequence represents a sequence of master pins configured to achieve the respective change key cut and the at least two master key cuts.

5 Claims, 44 Drawing Sheets

(56) References Cited

U.S. PATENT DOCUMENTS

| | | | | |
|---|---|---|---|---|
| 3,983,728 | A | 10/1976 | Phillips | |
| 3,991,596 | A | 11/1976 | Gartner | |
| 3,999,413 | A | 12/1976 | Raymond et al. | |
| 4,122,694 | A | 10/1978 | Gretler | |
| 4,142,389 | A | 3/1979 | Bahry et al. | |
| 4,231,242 | A | 11/1980 | Hill et al. | |
| 4,290,287 | A | 9/1981 | Peppard | |
| 4,377,082 | A | 3/1983 | Wolter | |
| 4,453,432 | A | 6/1984 | Widen | |
| 4,712,399 | A | 12/1987 | Mattossovich | |
| 4,836,002 | A | 6/1989 | Monahan | |
| 4,966,021 | A | 10/1990 | Boag | |
| 5,325,690 | A | 7/1994 | Adler et al. | |
| 5,495,733 | A | 3/1996 | Yen et al. | |
| 5,502,990 | A | 4/1996 | Hirvi | |
| 5,718,136 | A | 2/1998 | Aldieri et al. | |
| 6,076,386 | A | 6/2000 | Etchells et al. | |
| 6,119,495 | A | 9/2000 | Loreti | |
| 6,477,876 | B1 | 11/2002 | Kim | |
| 6,578,396 | B2 | 6/2003 | Field et al. | |
| 6,681,609 | B1 | 1/2004 | Preddey | |
| 6,860,131 | B2 | 3/2005 | Armstrong et al. | |
| 6,862,909 | B2 | 3/2005 | Armstrong et al. | |
| 6,871,520 | B2 | 3/2005 | Armstrong et al. | |
| 6,935,146 | B1 | 8/2005 | Lin | |
| 6,959,569 | B2 | 11/2005 | Strader et al. | |
| 6,973,813 | B2 | 12/2005 | Erdely | |
| 6,983,630 | B2 | 1/2006 | Eden, Jr. et al. | |
| 7,007,528 | B2 | 3/2006 | Chong et al. | |
| 7,028,517 | B2 | 4/2006 | Divito | |
| 7,047,778 | B2 | 5/2006 | Dimig et al. | |
| 7,114,357 | B2 | 10/2006 | Armstrong et al. | |
| 7,117,701 | B2 | 10/2006 | Armstrong et al. | |
| 7,162,900 | B1 | 1/2007 | Lu | |
| 7,162,901 | B2 | 1/2007 | Williams | |
| 7,181,937 | B2 | 2/2007 | Keller | |
| 7,181,938 | B2 | 2/2007 | Price | |
| 7,207,200 | B2 | 4/2007 | Eden, Jr. et al. | |
| 7,213,429 | B2 | 5/2007 | Armstrong et al. | |
| 7,225,651 | B2 | 6/2007 | Edwards et al. | |
| 7,234,331 | B2 | 6/2007 | Armstrong et al. | |
| 7,240,523 | B2 | 7/2007 | Johansson et al. | |
| 7,240,525 | B2 | 7/2007 | Sevillano Gil | |
| 7,290,418 | B2 | 11/2007 | Herdman | |
| 7,308,811 | B2 | 12/2007 | Armstrong et al. | |
| 7,322,219 | B2 | 1/2008 | Armstrong et al. | |
| 7,340,929 | B1 | 3/2008 | Christopoulos | |
| 7,836,739 | B2 * | 11/2010 | Huang et al. | 70/360 |
| 7,975,518 | B2 * | 7/2011 | Chiang et al. | 70/383 |
| 7,980,106 | B2 * | 7/2011 | Huang et al. | 70/383 |
| 8,056,378 | B2 * | 11/2011 | Huang et al. | 70/338 |
| 2006/0059965 | A1 * | 3/2006 | Benstead | 70/493 |
| 2006/0101880 | A1 * | 5/2006 | Ward-Dolkas et al. | 70/492 |
| 2006/0112748 | A1 | 6/2006 | Benstead | |
| 2007/0017264 | A1 | 1/2007 | Seliber | |
| 2007/0028658 | A1 | 2/2007 | Widen | |
| 2007/0051147 | A1 | 3/2007 | Widen | |
| 2007/0062230 | A1 | 3/2007 | Preddey | |
| 2007/0089468 | A1 | 4/2007 | Chong et al. | |
| 2007/0101782 | A1 | 5/2007 | Shen | |
| 2007/0186601 | A1 | 8/2007 | Lin | |
| 2007/0193317 | A1 | 8/2007 | Herdman | |
| 2007/0271976 | A1 | 11/2007 | Dalton et al. | |
| 2007/0289346 | A1 | 12/2007 | Hyatt, Jr. | |
| 2008/0011033 | A1 | 1/2008 | Chong et al. | |
| 2008/0078224 | A1 | 4/2008 | Wheatland et al. | |
| 2008/0092611 | A1 | 4/2008 | Armstrong et al. | |
| 2008/0163657 | A1 | 7/2008 | Dickhans et al. | |
| 2009/0217720 | A1 * | 9/2009 | Herdman | 70/385 |

FOREIGN PATENT DOCUMENTS

| | | |
|---|---|---|
| WO | WO 98/40589 | 9/1998 |
| WO | WO 2006/010080 | 1/2006 |
| WO | WO 2006/033864 | 3/2006 |

OTHER PUBLICATIONS

Chinese Patent Office Second Office Action for Application No. CN 200880019617.0 dated Oct. 22, 2012 with English Translation.

* cited by examiner (CONTINUED AT A)

Page 1 of Master Key System 450

| | | | | | | |
|---|---|---|---|---|---|---|
| ! | # | < | % | # | + | TMK |
| > | # | + | < | & | ! | |
| # | & | ! | + | ~ | > | |
| + | ! | % | = | > | < | |
| < | + | = | ? | ! | % | Progression |
| C | F | A | B | E | D | SOP |

| | |
|---|---|
| ! # < % # + | 16 Page Master (1 to 16) |
| ! # < % & + | 4 Page Master (1 to 4) |
| ! # < % & ! | Page Master |

> # < % & ! # # < % & ! + # < % & ! < # < % & !

451X

| | | | |
|---|---|---|---|
| > # + < & ! | # # + < & ! | + # + < & ! | < # + < & ! |
| > # ! < & ! | # # ! < & ! | + # ! < & ! | < # ! < & ! |
| > # % < & ! | # # % < & ! | + # % < & ! | < # % < & ! |
| > # = < & ! | # # = < & ! | + # = < & ! | < # = < & ! |
| > # + + & ! | # # + + & ! | + # + + & ! | < # + + & ! |
| > # ! + & ! | # # ! + & ! | + # ! + & ! | < # ! + & ! |
| > # % + & ! | # # % + & ! | + # % + & ! | < # % + & ! |
| > # = + & ! | # # = + & ! | + # = + & ! | < # = + & ! |
| > # + = & ! | # # + = & ! | + # + = & ! | < # + = & ! |
| > # ! = & ! | # # ! = & ! | + # ! = & ! | < # ! = & ! |
| > # % = & ! | # # % = & ! | + # % = & ! | < # % = & ! |
| > # = = & ! | # # = = & ! | + # = = & ! | < # = = & ! |
| * > # + % & ! | * # # + % & ! | * + # + % & ! | * < # + % & ! |
| * > # ! % & ! | * # # ! % & ! | * + # ! % & ! | * < # ! % & ! |
| * > # % % & ! | * # # % % & ! | * + # % % & ! | * < # % % & ! |
| * > # = % & ! | * # # = % & ! | * + # = % & ! | * < # = % & ! |

! # < < & !

! # < + & !

! # < = & !

* ! # < ? & !

Rekey Ma

500

501X

| | |
|---|---|
| > # + < & ! | # # + < & ! |
| > # ! < & ! | # # ! < & ! |
| > # < < & ! | # # < < & ! |
| > # < < & ! | # # < < & ! |
| > # + + & ! | # # + + & ! |
| > # ! + & ! | # # ! + & ! |
| > # < + & ! | # # < + & ! |
| > # < + & ! | # # < + & ! |
| > # + % & ! | # # + % & ! |
| > # ! % & ! | # # ! % & ! |
| > # < % & ! | # # < % & ! |
| > # < % & ! | # # < % & ! |
| > # + % & ! | # # + % & ! |
| > # ! % & ! | # # ! % & ! |
| > # < % & ! | # # < % & ! |
| > # < % & ! | # # < % & ! |

551X 550 Master Pin Matrices

| | | | |
|---|---|---|---|
| A A A C C C | B A A C C C | A A A C C C | B A A C C C |
| A A B C C C | B A B C C C | A A B C C C | B A B C C C |
| A A A C C C | B A A C C C | A A A C C C | B A A C C C |
| A A B C C C | B A B C C C | A A B C C C | B A B C C C |
| A A A B C C | B A A B C C | A A A B C C | B A A B C C |

Fig. 69

Page 1 of Master Key System

| | | | | | | |
|---|---|---|---|---|---|---|
| ! | # | < | % | # | + | TMK |
| > | # | + | < | & | ! | |
| # | & | ! | + | ~ | > | |
| + | ! | % | = | > | < | |
| < | + | = | ? | ! | % | Progression |
| C | F | A | B | E | D | SOP |

| | |
|---|---|
| ! # < % # + | 16 Page Master (1 to 16) |
| ! # < % & + | 4 Page Master (1 to 4) |
| ! # < % & ! | Page Master |

Rekey Ma

500

501Y

451Y

| | | | | |
|---|---|---|---|---|
| > # < % & ! | # # < % & ! | + # < % & ! | < # < % & ! | |
| > # + < & ! | # # + < & ! | + # + < & ! | < # + < & ! | |
| > # ! < & ! | # # ! < & ! | + # ! < & ! | < # ! < & ! | ! # < < & ! |
| > # % < & ! | # # % < & ! | + # % < & ! | < # % < & ! | |
| > # = < & ! | # # = < & ! | + # = < & ! | < # = < & ! | |
| > # + + & ! | # # + + & ! | + # + + & ! | < # + + & ! | |
| > # ! + & ! | # # ! + & ! | + # ! + & ! | < # ! + & ! | ! # < + & ! |
| > # % + & ! | # # % + & ! | + # % + & ! | < # % + & ! | |
| > # = + & ! | # # = + & ! | + # = + & ! | < # = + & ! | |
| > # + = & ! | # # + = & ! | + # + = & ! | < # + = & ! | |
| > # ! = & ! | # # ! = & ! | + # ! = & ! | < # ! = & ! | ! # < = & ! |
| > # % = & ! | # # % = & ! | + # % = & ! | < # % = & ! | |
| > # = = & ! | # # = = & ! | + # = = & ! | < # = = & ! | |
| * > # + % & ! | * # # + % & ! | * + # + % & ! | * < # + % & ! | |
| * > # ! % & ! | * # # ! % & ! | * + # ! % & ! | * < # ! % & ! | * ! # < ? & ! |
| * > # % % & ! | * # # % % & ! | * + # % % & ! | * < # % % & ! | |
| * > # = % & ! | * # # = % & ! | * + # = % & ! | * < # = % & ! | |

| | |
|---|---|
| > # + < & ! | # # + < & ! |
| > # ! < & ! | # # ! < & ! |
| > # < < & ! | # # < < & ! |
| > # < < & ! | # # < < & ! |
| > # + + & ! | # # + + & ! |
| > # ! + & ! | # # ! + & ! |
| > # < + & ! | # # < + & ! |
| > # < + & ! | # # < + & ! |
| > # + % & ! | # # + % & ! |
| > # ! % & ! | # # ! % & ! |
| > # < % & ! | # # < % & ! |
| > # < % & ! | # # < % & ! |
| > # + % & ! | # # + % & ! |
| > # ! % & ! | # # ! % & ! |
| > # < % & ! | # # < % & ! |
| > # < % & ! | # # < % & ! |

551Y 550 Master Pin Matrices

| | | | |
|---|---|---|---|
| A A A C C C | B A A C C C | A A A C C C | B A A C C C |
| A A B C C C | B A B C C C | A A B C C C | B A B C C C |
| A A A C C C | B A A C C C | A A A C C C | B A A C C C |
| A A B C C C | B A B C C C | A A B C C C | B A B C C C |
| A A A B C C | B A A B C C | A A A B C C | B A A B C C |

Fig. 70

MASTER KEYING SYSTEM AND METHOD FOR PROGRAMMABLE LOCK CYLINDER ASSEMBLIES

BACKGROUND OF THE INVENTION

The present invention relates to lock cylinder assemblies. More particularly, the present invention relates to lock cylinder assemblies that may be reprogrammed without removing the cylinder plug. Most particularly, the present invention relates to a master keying system and method for programmable lock cylinder assemblies.

FIGS. 71A through 71C show a typical pin tumbler cylinder 510. The cylinder 510 consists of a shell 512 having a rotatable plug 513 within. The plug 513 has an axially extending keyway 514, which accepts key 515. A series of cuts 516 are placed on the upper edge of key 515. Within the shell 512 and plug 513 are a plurality of pins 520 and springs 521. Pins 520 are comprised of at least two segments, a bottom pin 520*a* and a top pin or driver 520*b*. When a cylinder has been pinned for master keying, one or more master pins 520*c* (see FIGS. 71D and 71E) are used in each pin stack. The depths of the cuts 516 on the key 515 are called bittings and typically are numbered from 0 to 9. With no key 515 inserted in the cylinder 510, the top pins 520*b* and bottom pins 520*a* are forced by the springs 521 down into the plug 513. The top pins 520*b* are then partially in the shell 512 and partially in the plug 513, forming an obstacle that keep the plug 513 from turning, as shown in FIG. 71A. When a proper key 515 is inserted into the cylinder 510, the bitting depth of the cuts 516 brings the top of each of the bottom pins 520*a* exactly to the surface of the plug 513, forming a shear line 524, as shown in FIG. 71B. With the tops of the bottom pins 520*a* aligned with the shear line 524, the key 515 and the plug 513 can be turned. When an incorrect key 515 is inserted, one or more of the top and bottom pins 520*b*, 520*a* will not align with the shell 512 surface to form the shear line 524, thereby preventing rotation of the key 515 and plug 513, as shown in FIG. 71C.

FIGS. 71D and 71E illustrate a typical cylinder 510 which has been pinned for master keying. The term "master keyed" usually denotes that each individual cylinder is operated by two or more different keys. The key that normally opens only one cylinder or keyed alike group of cylinders is called a change key. The key that opens all the cylinders in a group or series is called a master key. An example of a simple master key system would be in a small office building. There would be an individual change key for each office door, and there would be a master key to operate all office doors. The essential difference between an ordinary pin tumbler cylinder and a master keyed cylinder is the use of master pins 520*c*. A master pin is an additional top pin, usually shorter, which is inserted between the bottom pin 520*a* and the top pin 520*b*. In each pin chamber where a master pin 520*c* is located, a second shear position is created. The cylinder can be operated at either shear position. Thus, different key bittings can be used for each position where there is a master pin. FIG. 71D shows a master keyed cylinder 510 with a change key 515 inserted and FIG. 71E shows the same master keyed cylinder 510 with a master key 515 inserted. In both figures, the pins 520 have aligned to form a shear line 524, thereby permitting the key 515 and plug 513 to rotate.

When reprogramming a lock cylinder 510 using a traditional cylinder design, the user is required to remove the cylinder plug 513 from the cylinder body 512 and replace the appropriate pins 520 so that a new key can be used to unlock the cylinder 510. This typically requires the user to remove the cylinder mechanism from the lockset and then disassemble the cylinder to some degree to remove the plug 513 and replace the pins 520. This requires a working knowledge of the lockset and cylinder mechanism and is usually only performed by locksmiths or trained professionals. Additionally, the process usually employs special tools and requires the user to have access to pinning kits to interchange pins 520 and replace components that can get lost or damaged in the reprogramming process.

SUMMARY OF THE INVENTION

In at least one aspect, the present invention provides a master key system for a reprogrammable lock cylinder with at least one first master pin and one second master pin. The first and second master pins have different bitting configurations. The master key system according to at least one embodiment includes at least a first array of change key cuts corresponding to an input key bitting array and sequence of progression and at least two master key cuts corresponding to the input key bitting array and sequence of progression and each of the change key cuts. The system further comprises at least one master pin matrix including a master pin sequence for each change key cut and at least one rekey matrix including a rekey cut for each change key. Each master pin sequence represents a sequence of master pins configured to achieve the respective change key cut and the at least two master key cuts.

In another aspect, the present invention provides a method of master keying a reprogrammable lock cylinder with at least one first master pin and one second master pin, the first and second master pins having different bitting configurations. The method comprises the steps of generating at least a first array of change key cuts corresponding to an input key bitting array and sequence of progression; generating at least two master key cuts corresponding to the input key bitting array and sequence of progression and each of the change key cuts; generating at least one master pin matrix including a master pin sequence for each change key cut, each master pin sequence representing a sequence of master pins configured to achieve the respective change key cut and the at least two master key cuts; and generating at least one rekey matrix including a rekey cut for each change key.

BRIEF DESCRIPTION OF THE DRAWINGS

FIGS. 69 and 70 are expanded views of a portion of the page master of FIG. 65 illustrating a rekeying sequence.

DETAILED DESCRIPTION OF THE INVENTION

Figure 1:
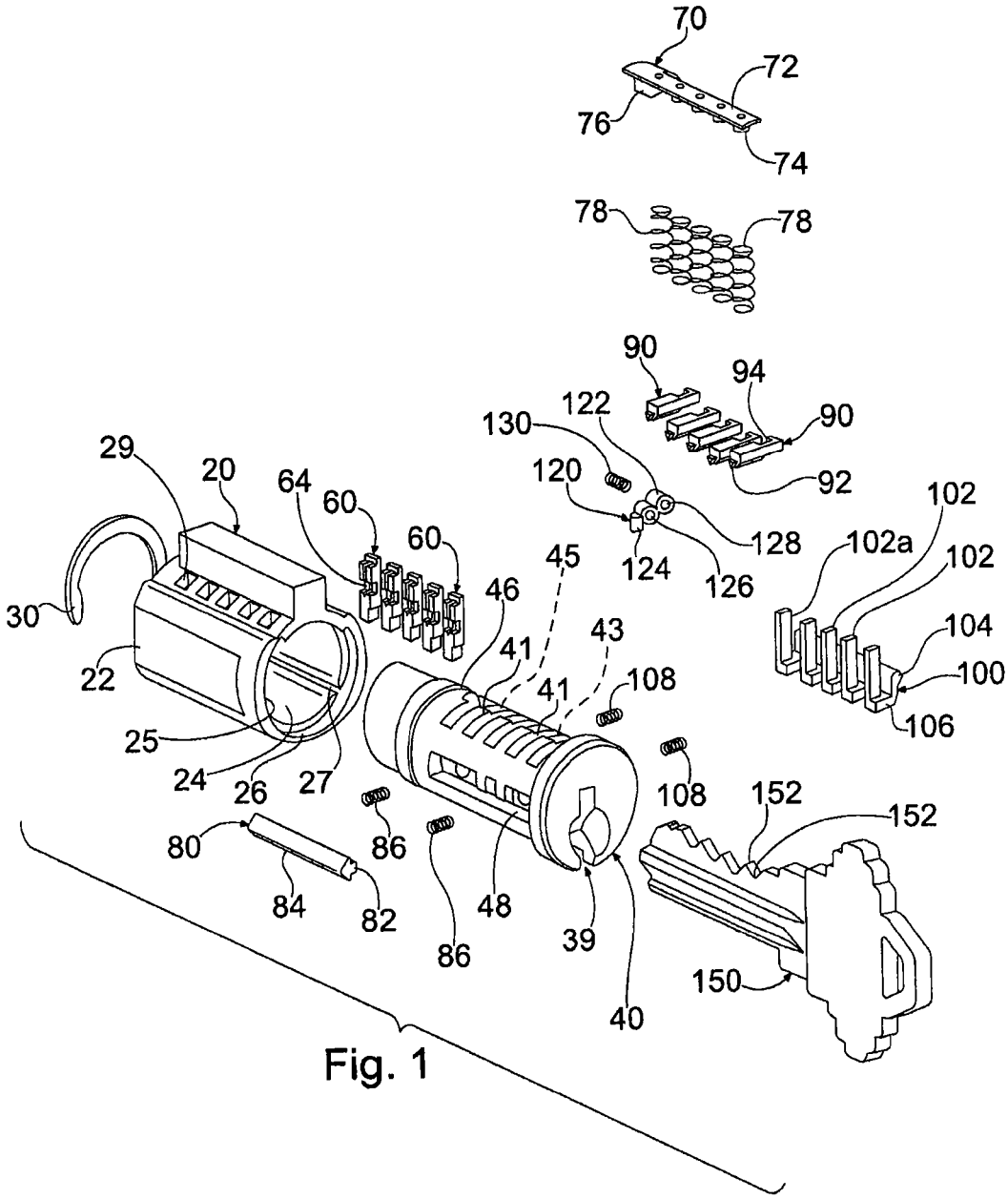
FIG. 1 is an exploded isometric view of a programmable lock cylinder assembly according to a first embodiment of the invention.

Although the invention is illustrated and described herein with reference to specific embodiments, the invention is not intended to be limited to the details shown. Rather, various modifications may be made in the details within the scope and range of equivalents of the claims and without departing from the invention.

The following are definitions of a few common master keying terms:

Master key system is any keying arrangement that has two or more levels of keying.

Change key is a key that operates only one cylinder or one group of keyed alike cylinders in a keying system.

Bitting is the number(s) which represent the dimensions of the key cut(s) on a key.

Key bitting array is a matrix (graphic) display of all possible bittings for change keys and master keys as related to the top master key.

Levels of keying are the divisions of a master key system into hierarchies of access. Level 1 is the lowest level and consists only of change keys. The highest level is the top master key that operates all locks in the master key system.

MACS is maximum adjacent cut specification, or the maximum allowable difference between adjacent cut depths.

Cross keying is the deliberate process of combinating a cylinder (usually in a master key system) to two or more different keys which would not normally be expected to operate it together.

Master key is a key which operates all the master keyed locks or cylinders in a group, each lock or cylinder usually being operated by its own change key.

Page master key is the master key for all combinations listed on a page in the standard progression format.

Block master key is the master key for all combinations listed as a block in the standard progression format.

Horizontal group master key is the master key for all combinations listed in all blocks in a line across the page in the standard progression format.

Vertical group master key is the master key for all combinations listed in all blocks in a line down a page in the standard progression format.

Row master key is the master key for all combinations listed on the same line across a page in the standard progression format.

Grand master key is a key which operates two or more separate groups of locks, which are each operated by a different master key.

Sequence of progression is the order in which bitting positions are progressed to obtain change key combinations, typically either a 1 step, using a one increment difference between bittings of a given position, or 2 step progression, using a two increment difference between bittings of a given position.

Standard progression format is a systematic method of listing and relating all change key combinations to all master key combinations in a master key system. The listing is divided into segments known as blocks, horizontal groups, vertical groups, rows, and pages, for levels of control.

The master keying system and method of the present invention is useable with programmable lock cylinder assemblies having various configurations. For example, in the embodiments described below, the lock cylinder assemblies include selectively engagable rack pins and tongue pins. U.S. Pat. No. 7,322,219 discloses another programmable lock cylinder using racks engagable with modified pins. U.S. Pat. No. 6,119,495 describes a programmable lock cylinder using wafers and differently configured split pin assemblies. U.S. Pat. No. 7,047,778 describes a programmable lock cylinder using pivotal tumbler members. The master keying system and method of the present invention is useable with any programmable lock cylinder having at least two distinct master pins positional within the lock cylinder. The master pins may be racks, pins, tumblers, wafers or any other lock cylinder locking member having at least two unlocking bitting positions.

An illustrative programmable lock cylinder assembly 10 useable with the master keying system and method of the invention is illustrated and described with reference to FIGS. 1-28 and 56-63. Referring to FIGS. 1-9, the programmable lock assembly 10 generally comprises a lock housing 20 and a cylinder plug 40. The lock housing 20 includes a body 22 defining a generally tubular opening 24 extending the length thereof. The tubular opening 24 is configured to receive the cylindrical body 42 of the cylinder plug 40 and may include a shoulder 26 about the opening 24 which engages a flange 44 on one end of the cylinder plug 40. Referring to FIG. 2, the cylinder plug 40 preferably extends out the opposite end of the housing 20 and is configured for connection to an output mechanism (not shown) for transmitting force from the cylinder plug 40 to one or more elements connected to the lock cylinder assembly 10. The output mechanism can take a number of different forms, including without limitation, a lever, drive shaft, coupling, cam, or other element mounted to the lock cylinder assembly 10. The present lock cylinder assembly may be utilized in any desired application. In the illustrated embodiment, a snap ring 30 engages a groove 46 in the cylinder body 42 to retain the lock cylinder assembly 10 in the assembled state illustrated in FIG. 2.

Figure 2:
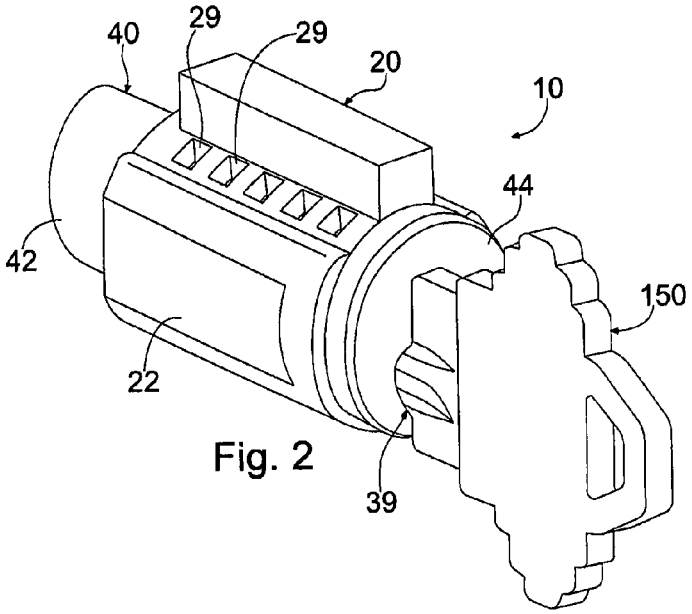
FIG. 2 is an assembled isometric view of the programmable lock cylinder assembly of FIG. 1 with a key inserted therein.
Figure 3:
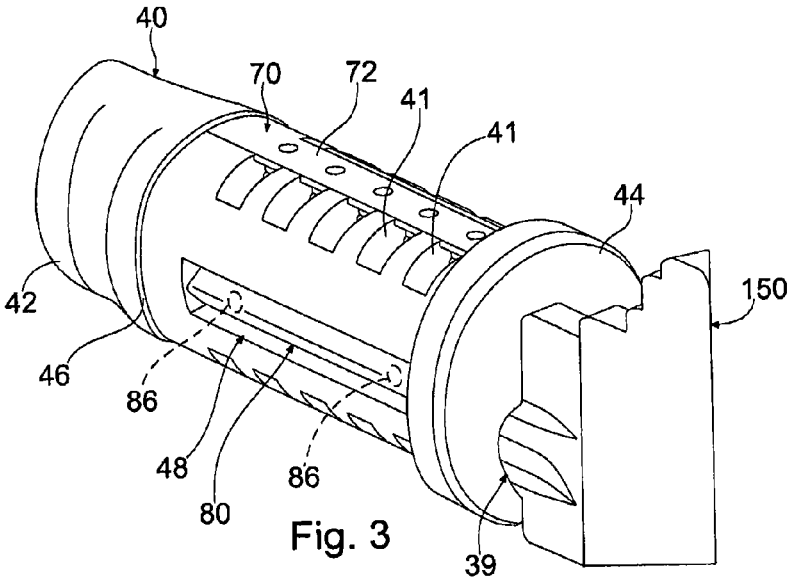
FIG. 3 is an isometric view similar to FIG. 2 with the lock housing removed and the sidebar shown translucently.
Figure 4:
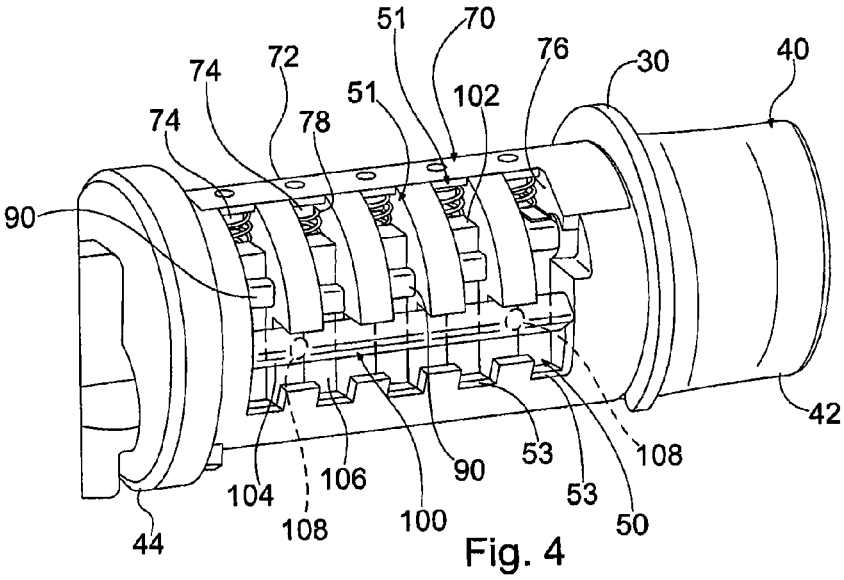
FIG. 4 is a right-side isometric view of the lock cylinder plug with the re-combinating sidebar shown translucently.
Figure 5:
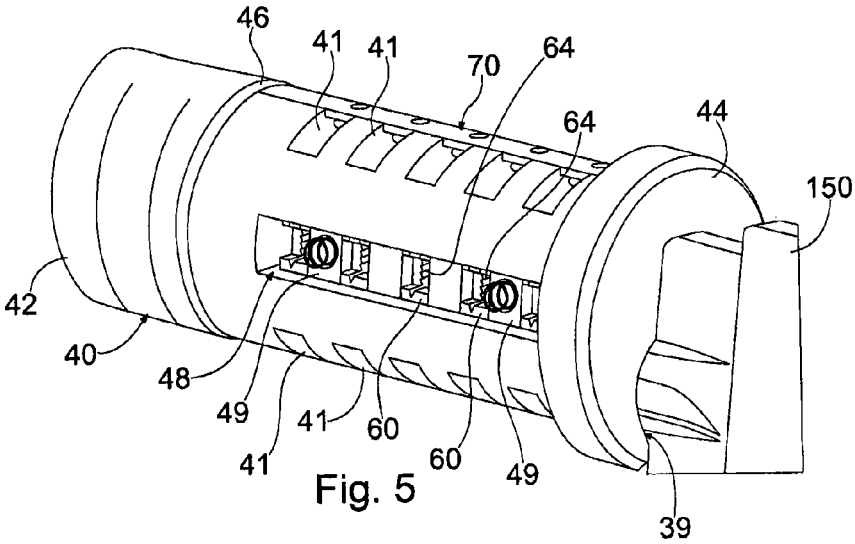
FIG. 5 is a left-side isometric view of the lock cylinder plug with the locking sidebar removed.
Figure 7:
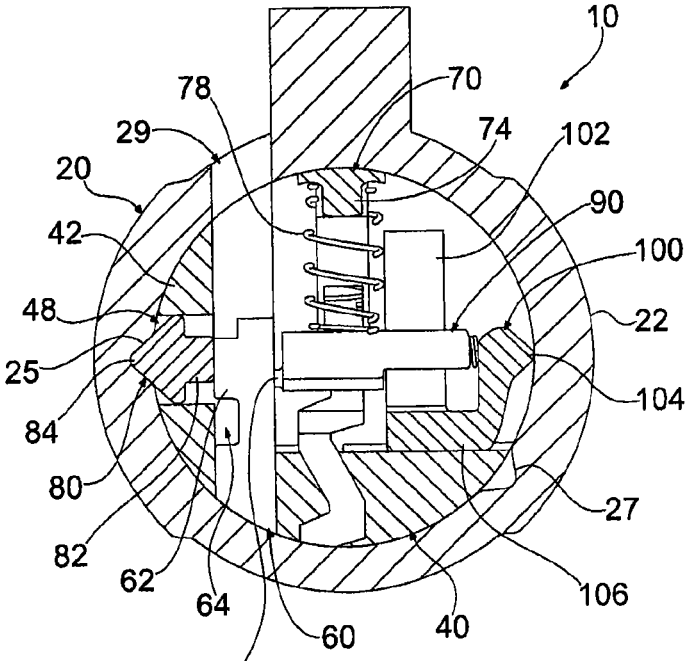
FIG. 7 is a cross-sectional view along line 7-7 in FIG. 2 with the lock cylinder assembly in a home position.

Referring to FIGS. 1 and 7, the housing body 22 includes a pair of tapered groove 25 and 27 extending along the inside surface of the opening 24. As explained in greater detail hereinafter, a sidebar 80 extends from the cylinder plug 40 and engages the tapered groove 25 to maintain the cylinder plug 40 rotationally locked relative to the housing 20 unless a proper key is positioned in the keyway 39 of the cylinder plug 40. The tapered groove 27 facilitates reprogramming of the lock cylinder assembly 10, as described in more detail hereinafter.

Figure 8:
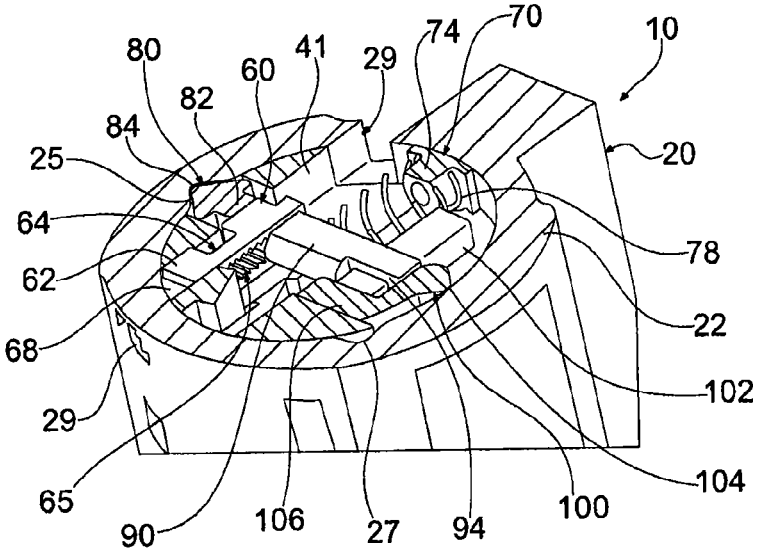
FIG. 8 is an isometric view of the lock cylinder assembly as shown in FIG. 7.

Referring to FIGS. 1 and 8, the housing body 22 may include a plurality of through bores 29 which align with rack pin bores 41 of the cylinder plug 40 when the cylinder plug 40 is positioned in a home position. The through bores 29 are configured to receive a portion of an associated rack pin 60, as described hereinafter, to further maintain the cylinder plug 40 rotationally locked relative to the housing 20 unless a proper key is positioned in the keyway 39 of the cylinder plug 40. Desirably, through bores 29 are provided on the upper and lower surfaces, in the illustrated orientation, such that the lock cylinder assembly 10 may be provided with upper and lower rack pins, if desired, for operation with a key having teeth on its upper and lower surfaces.

Referring to FIGS. 1, 3 and 5-8, the rack pin bores 41 extend substantially parallel to the keyway 39 of the cylinder plug 40. Each rack pin bore 41 is configured to receive and guide the axial movement of a rack pin 60. Each rack pin bore 41 desirably extends completely through the cylinder plug 40 such that the associated rack pin 60 may be configured to be moved upward or downward into engagement with an associated through bore 29, however, such is not required. Alternatively, the rack pin bores 41 may only extend from one surface of the cylinder plug body 42, or may even be completely internal within the cylinder plug body 42 such that the rack pins do not extend from the cylinder plug 40.

Referring to FIGS. 1, 3, 5 and 7, a sidebar opening 48 extends through a side surface of the cylinder body 42 in communication with the rack pin bores 41. The sidebar opening 48 is sized to receive a sidebar 80 such that a tapered portion 84 of the sidebar 80 is radially extendable from the cylinder plug 40. In the home position illustrated in FIG. 7, the tapered portion 84 extends from the cylinder plug 40 and is engaged in the tapered groove 25 to rotationally lock the cylinder plug 40 relative to the housing 20. One or more springs 86 are positioned between a rail portion 82 of the sidebar 80 and internal portions 49 of the cylinder body 42 to bias the sidebar radially outward.

Figure 9:
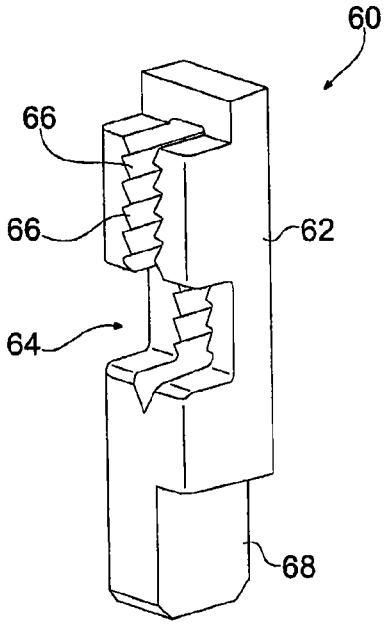
FIG. 9 is an isometric view of a rack pin in accordance with a first embodiment of the invention.

The sidebar 80 is prevented from being moved radially inward, and thereby unlocking the lock, by the rack pins 60 unless a proper key is positioned in the keyway 39. An exemplary non-master rack pin 60 is illustrated in FIG. 9. The exemplary rack pin 60 includes an elongate body 62 generally having a width slightly less than the width of an associated rack pin bore 41 such that the rack pin 60 is axially movable therein. In the present embodiment, an end 68 of the rack pin 60 has a reduced width and is configured to be received in a corresponding housing through bore 29. The rack pin 60 includes a plurality of engagement passages 66 which facilitate programming of the lock cylinder assembly 10 as will be described in more detail hereinafter.

Figure 10:
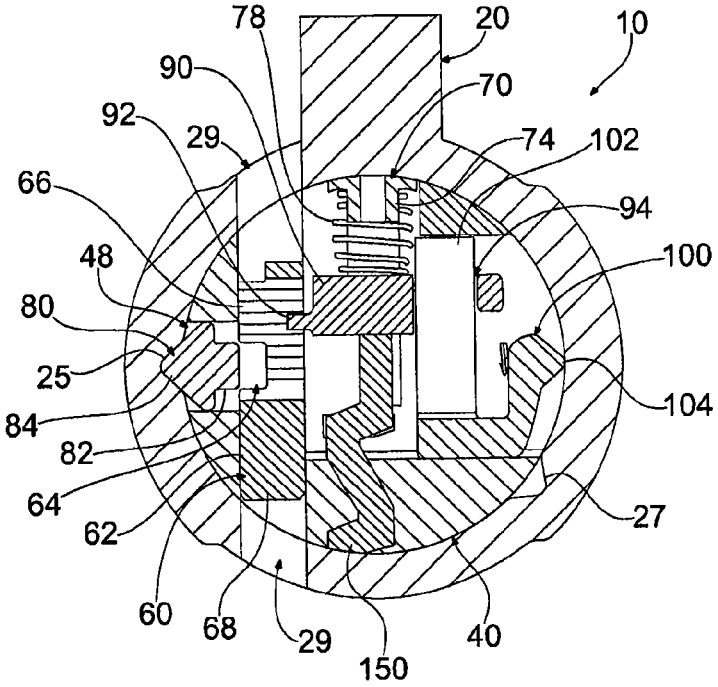
FIG. 10 is a cross-sectional view similar to FIG. 7 with a key inserted into the lock cylinder assembly.
Figure 11:
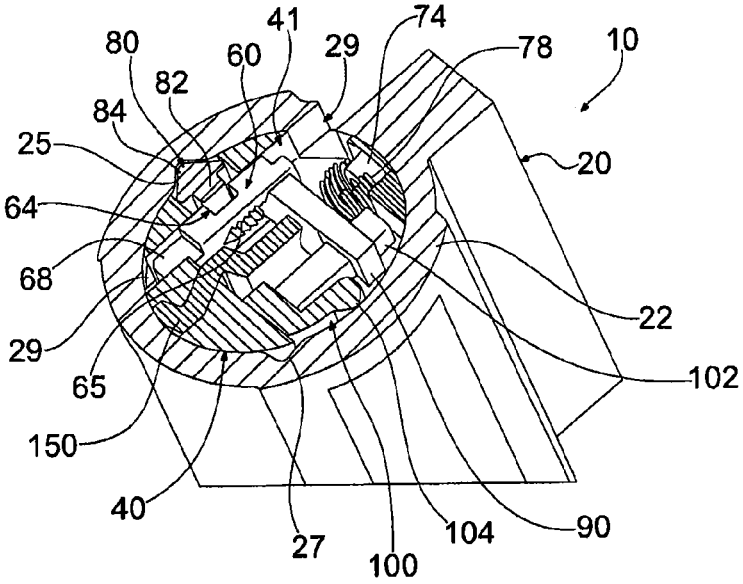
FIG. 11 is an isometric view of the lock cylinder assembly as shown in FIG. 10.
Figure 12:
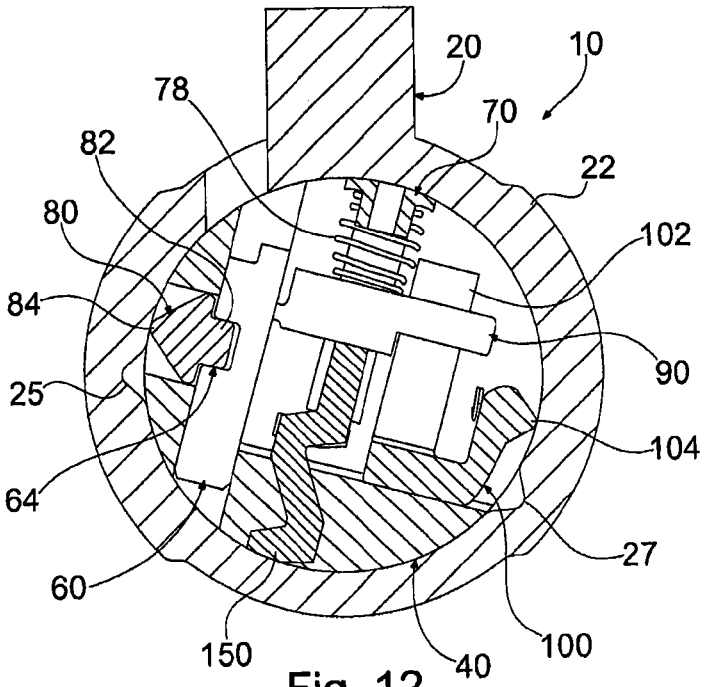
FIG. 12 is a cross-sectional view similar to FIG. 7 with a key inserted into the lock cylinder assembly and the cylinder plug rotated to an unlock position.
Figure 13:
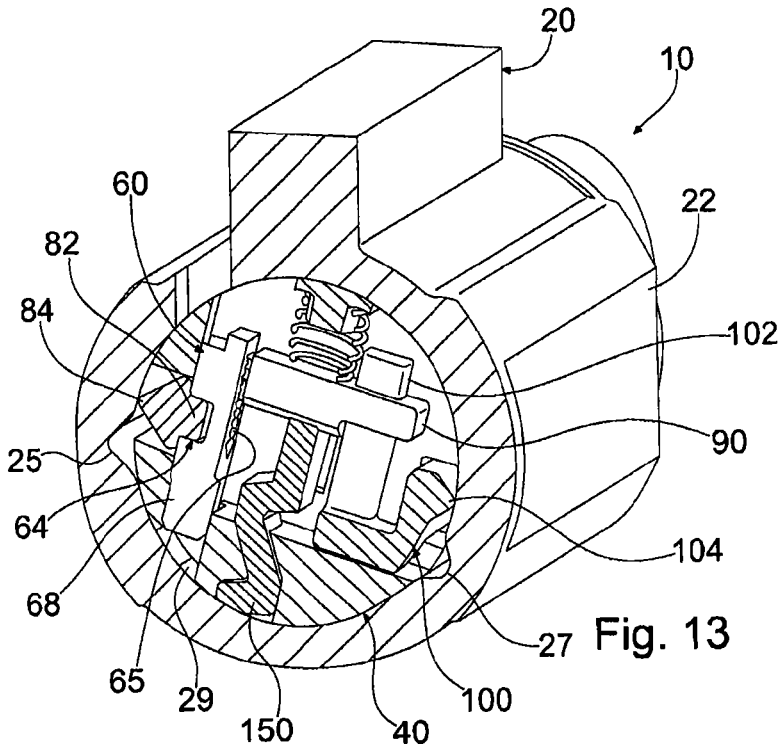
FIG. 13 is an isometric view of the lock cylinder assembly as shown in FIG. 12.

The rack pin 60 also includes a sidebar notch 64 configured to receive the rail portion 82 of the sidebar 80. As illustrated in FIG. 7, the rack pin body 62 generally has a thickness such that the rack pin body 62 contacts the sidebar rail portion 82 and prevents radial movement of the sidebar 80. When a proper key 150 is inserted in the keyway 39, the rack pin 60 is moved axially, as described below, such that the sidebar notch 64 is aligned with the sidebar rail portion 82 as shown in FIG. 10. With each rack pin 60 so aligned, the sidebar 80 is movable radially inward. In the present embodiment, the sidebar 80 does not automatically move radially inward, but instead is biased radially outward as explained above. Referring to FIG. 12, with the proper key 150 inserted, the rack pins 60 are disengaged from the through bores 29 and the sidebar notches 64 are properly aligned, such that rotation of the key 150 causes the tapered portion 84 of the sidebar 80 to ride up the tapered groove 25 as the sidebar rail portion 82 is received in the notches 64. The lock cylinder assembly 10 is in an unlocked condition such that the cylinder plug 40 is rotatable relative to the housing 20. Rotation of the cylinder plug 40 actuates the output mechanism. When the key 150 is rotated back to the home position, the sidebar 80 automatically extends radially into engagement with the tapered groove 25. When the key 150 is removed, the rack pins 60 return to the home position wherein the notch 64 is no longer aligned with the sidebar rail portion 82 and the sidebar 80 is prevented from moving radially inward.

Figure 56:
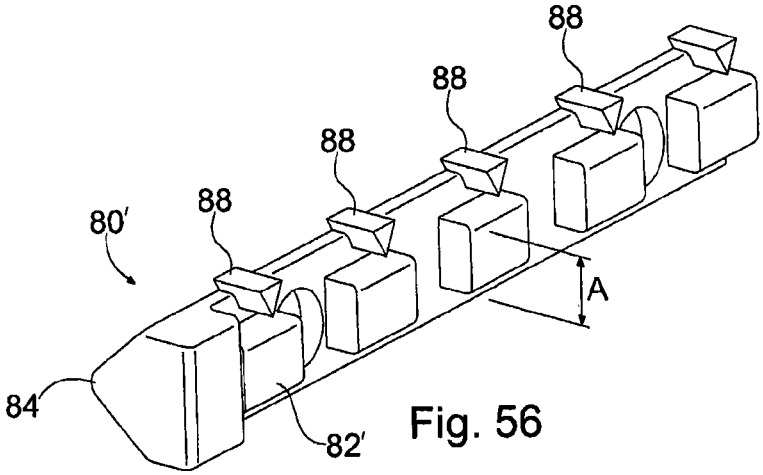
FIG. 56 is an isometric view of a locking sidebar in accordance with an alternative embodiment of the invention.

Referring to FIGS. 56-63, the master key capability is achieved utilizing a master locking sidebar 80' and master rack pins 60A' and 60B', either alone or in combination with non-master rack pins 60. Referring to FIG. 56, the master locking sidebar 80' includes a tapered portion 84 and a rail portion 82'. In the present embodiment, the rail portion 82' is segmented rather than a continuous rail. The rail portion 82' has a height A and is configured to be received in notches 64' in the rack pins 60A' and 60B'. Master bar tongues 88 are provided along the sidebar 80' and are configured to align with the engagement passages 66' in the master rack pins 60A' and 60B'.

Figure 57:
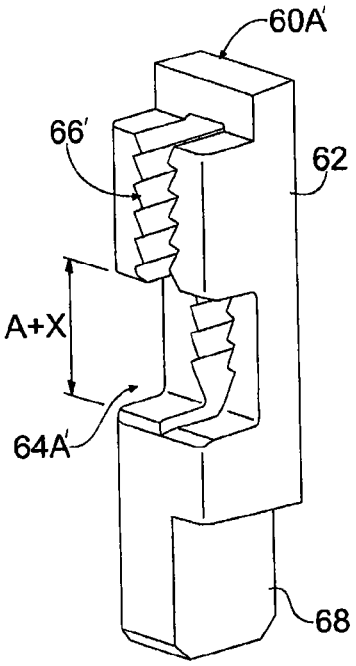
FIGS. 57 and 58 are isometric views of rack pins in accordance with alternative embodiments of the invention.
Figure 59:
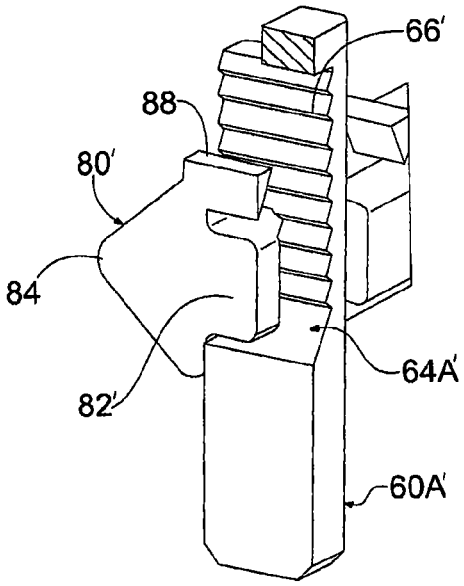
FIGS. 59-63 are isometric views illustrating engagement of the locking sidebar of FIG. 56 with the rack pins of FIGS. 57 and 58 in various positions.
Figure 60:
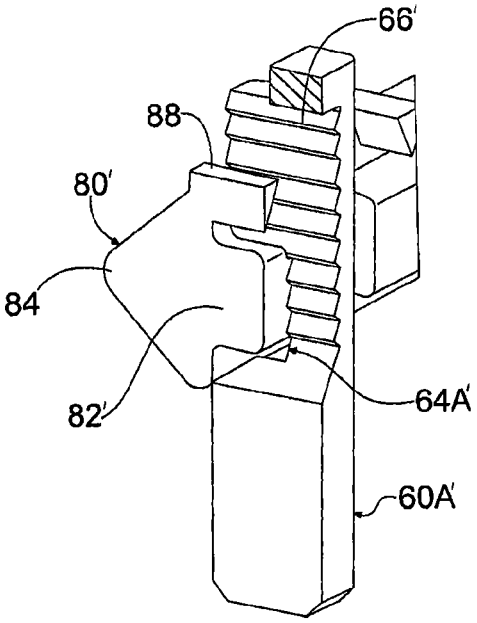

Referring to FIG. 57, master rack pin 60A' includes a body 62 with a sidebar notch 64A' configured to receive the sidebar rail portion 82'. The master rack pin 60A' also includes a series of engagement passages 66' configured to receive the tongue pin tongues 92 as in the previous embodiment and to also receive the master bar tongues 88. The height of the notch 64A' is equal to the rail portion height A plus the height X of one of the engagement passages 66'. As such, as illustrated in FIGS. 59 and 60, the rail portion 82' will be received in the notch 64' based on two different key configurations, one being one bitting away from the other.

Figure 58:
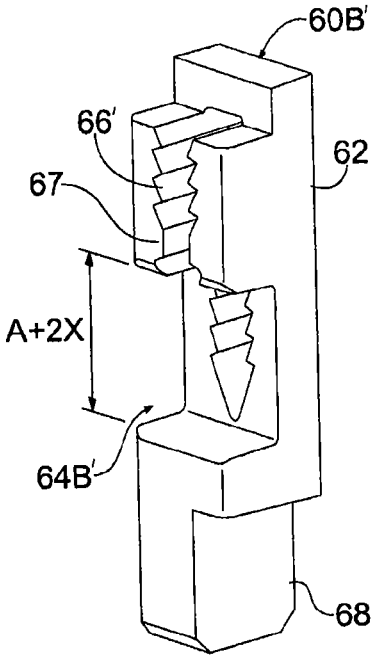
Figure 61:
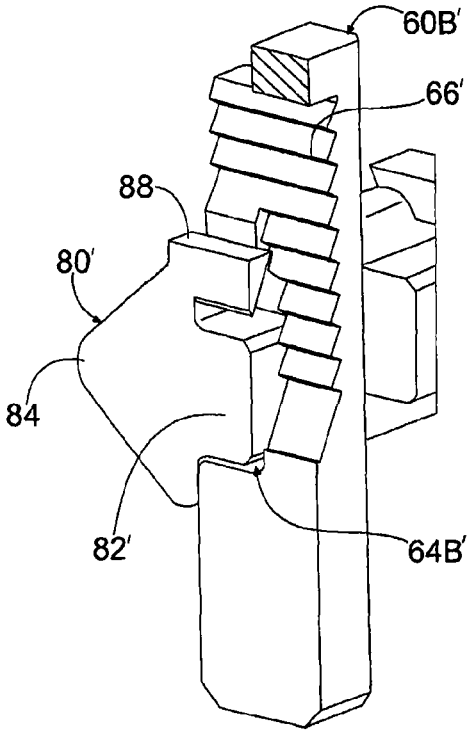
Figure 62:
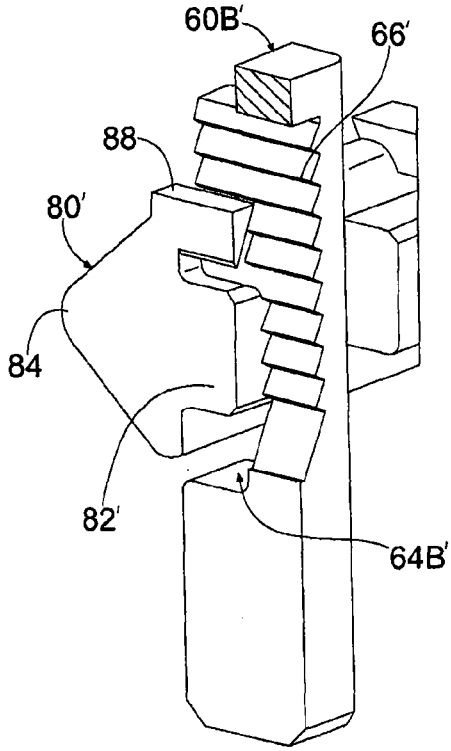
Figure 63:
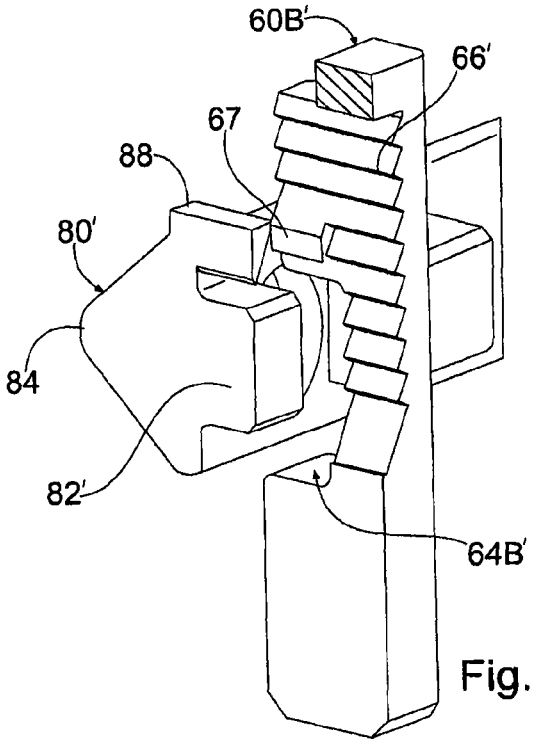

Referring to FIG. 58, master rack pin 60B' includes a body 62 with a sidebar notch 64B' configured to receive the sidebar rail portion 82'. The master rack pin 60B' also includes a series of engagement passages 66' configured to receive the tongue pin tongues 92 as in the previous embodiment and to also receive the master bar tongues 88. The height of the notch 64A' is equal to the rail portion height A plus the height 2X of two of the engagement passages 66'. However, to prevent the toothing of rack pin 60A' from also working in rack pin 60B', the passage 66' two above the notch 64B', is blocked by a blocker 67 therein. As such, as illustrated in FIGS. 61 and 62, the rail portion 82' will be received in the notch 64' based on two different key configurations, one being two bittings away from the other, however, it will not be receivable based on only one bitting difference as the master bar tongue 88 will contact the blocker 67. Other variations in the size and bitting arrangement may also be utilized.

Operation of the lock cylinder assembly 10 will be described with reference to non-master rack pins 60 and non-master sidebar 80, but generally operates in the same manner with the master rack pins 60A' and 60B' and the master locking sidebar 80'.

To facilitate axial movement of the rack pins 60 in response to an inserted key, each rack pin 60 is associated with a tongue pin 90 which extends perpendicular to the rack pin 60 across the keyway 39. Each tongue pin 90 includes a tongue 92 that is selectively engagable with one of the engagement passages 66 of the rack pin 60 through an opening 65 in the back of the rack pin 60 (see FIGS. 8-10). In the present embodiment, the engagement passages 66 have a serrated configuration and the tongues 92 have a corresponding inverted triangular configuration, however, other complementary configurations may also be utilized.

Figure 6:
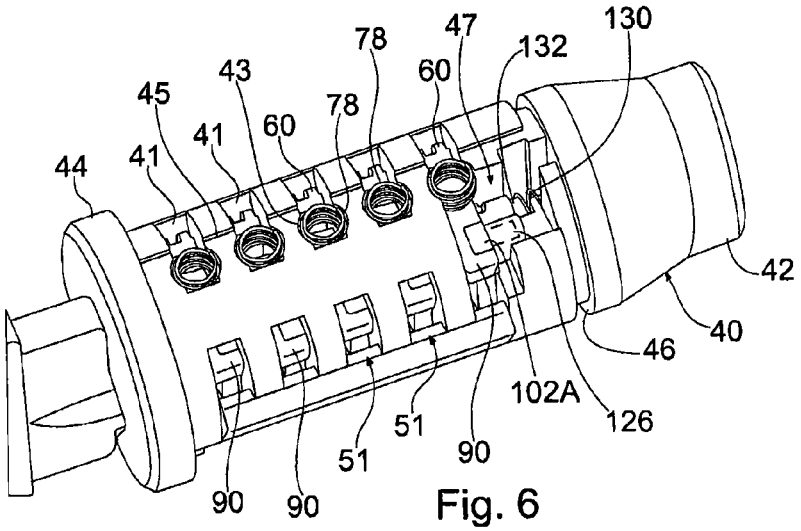
FIG. 6 is a top isometric view of the lock cylinder plug with the top cover removed.

In the present embodiment, a spring 78 or the like extends between a top cover 70 and the respective tongue pin 90 to bias the tongue pin 90 downward. When the tongue pin 90 is engaged with a corresponding rack pin 60, the spring 78 thereby biases the rack pin 60 toward the locked position wherein the rack pin end 68 extends into the housing though bore 29 and the notch 64 is not aligned with the sidebar rail portion 82. The present top cover 70 includes an inward spring mount 74 depending from its body 72 for each spring 78. As shown in FIG. 6, the cylinder body 42 desirably includes a spring bore 43 for each spring 78 and mount 74 and a channel 45 configured to receive the top cover body 72. The spring bores 43 may be formed integrally with the rack pin bores 41 as illustrated. The top cover 70 also includes a depending portion 76 configured to cover and retain a reset actuator 120 positioned within a cavity 47 of the cylinder body 42.

In the present embodiment, a re-combinating sidebar 100 is utilized to control the selective engagement between the tongue 92 and the engagement passage 66, as described in more detail below. Referring to FIGS. 1, 4, 6 and 7, the re-combinating sidebar 100 includes a plurality of shaft portions 102, each configured to be received in an alignment notch 94 of a corresponding tongue pin 90. A tapered bar 104 extends perpendicular from the shaft portions 102 and is connected thereto by bridging members 106. The cylinder body 42 includes a plurality of vertical slots 51, each configured to receive a corresponding shaft portion 102 with a tongue pin 90 engaged therewith. Each vertical slot 51 terminates in a horizontal slot 53 configured to receive a corresponding bridging member 106 and thereby guide radial movement of the re-combinating sidebar 100. A horizontal opening 50 extends through the side of the cylinder body 42 and is in communication with the vertical slots 51 such that the tapered bar 104 may extend radially outwardly from the cylinder plug 40. A plurality of springs 108 or the like are positioned between the cylinder body 42 and the tapered bar 104 such that the re-combinating sidebar 100 is biased radially outward.

Referring to FIG. 7, during normal operation, the re-combinating sidebar 100 is maintained in a radially inward position such that each tongue 92 of the tongue pins 90 remains engaged with the intended engagement passage 66 of the corresponding rack pin 60. With reference to FIGS. 1, 6, 17 and 18, a reset actuator 120 is engagable between the cylinder body 42 and the re-combinating sidebar 100 to maintain the re-combinating sidebar 100 in this radially inward, normal operation mode. The reset actuator 120 includes an actuator body 122 with a reset contact 124 depending therefrom. A front face of the actuator body 122 includes two bores 126 and 128. Each bore 126, 128 is configured to receive a post 103 extending rearward from rearward most shaft portion 102A (see FIG. 17). In the normal operating mode, the post 103 is received in inward bore 126, as shown in phantom in FIG. 6, and thereby maintains the re-combinating sidebar 100 in the radially inward, normal operating position. A spring 130 or the like engages a mount 132 on the rear side of the actuator body 122 and biases the reset actuator 120 toward the re-combinating sidebar 100, thereby maintaining the post 103 engaged within the bore 126 unless an proper reset key 150' is positioned in the keyway 39.

Figure 14:
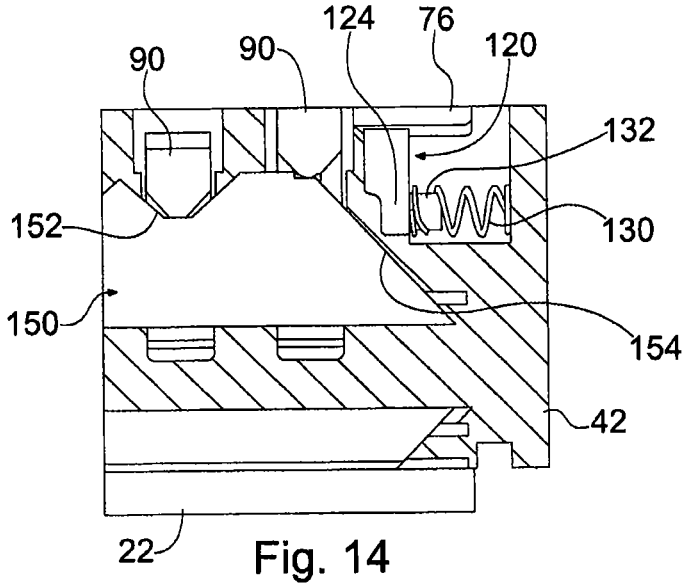
FIG. 14 is a cross-sectional view illustrating the relative position of a user key to the reset actuator during normal operation.
Figure 15:
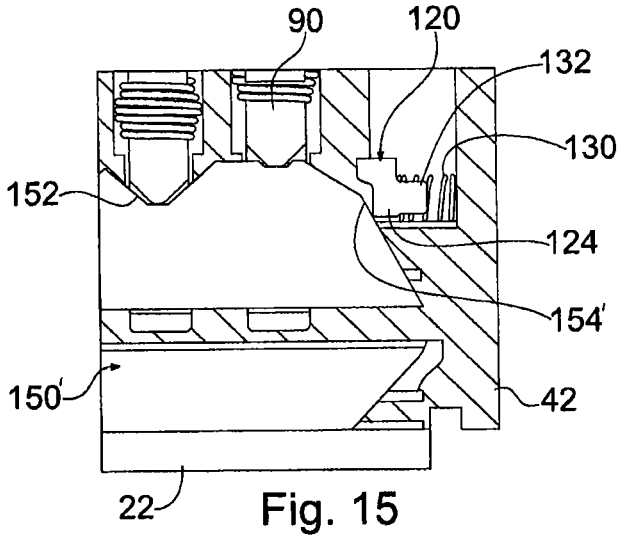
FIG. 15 is a cross-sectional view similar to FIG. 14 illustrating the engagement of a reset key with the reset actuator.
Figure 16:
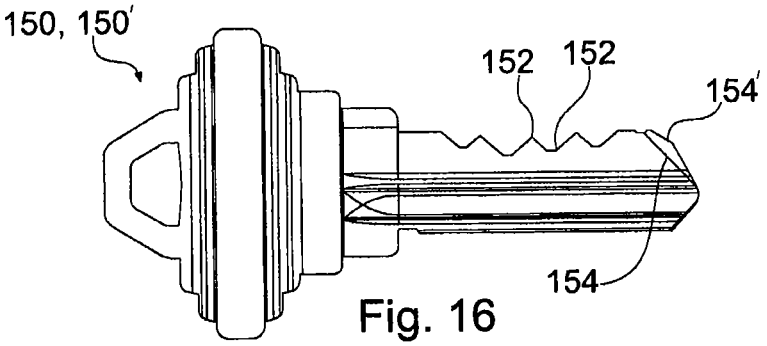
FIG. 16 is a side elevational view of a key illustrating both a user key configuration and a reset key configuration.

Referring to FIGS. 14-16, the present embodiment of the invention utilizes two distinct types of keys, namely a user key 150 and a reset key 150'. Both keys 150, 150' include a plurality of teeth and notches 152, but the reset key 150' includes a protruding tip 154' compared to the tapered tip 154 of the user key 150. As shown in FIG. 14, during normal operation, a user inserts a user key 150 and the tapered tip 154 remains clear of the actuator reset contact 124. The actuator 120 remains biased by the spring 130 toward the re-combinating sidebar 100, thereby maintaining the post 103 engaged within the bore 126. As such, the re-combinating sidebar 100 is maintained in the inward position and each tongue 92 remains engaged with the previously programmed engagement passage 66. A user can insert a proper user key 150 which will engage the tongue pins 90 which in turn will move the rack pins 60 axially such that the rack pin notches 64 are aligned with the sidebar rail portion 82. The lock cylinder assembly 10 may be utilized in a normal manner as described above.

Figure 17:
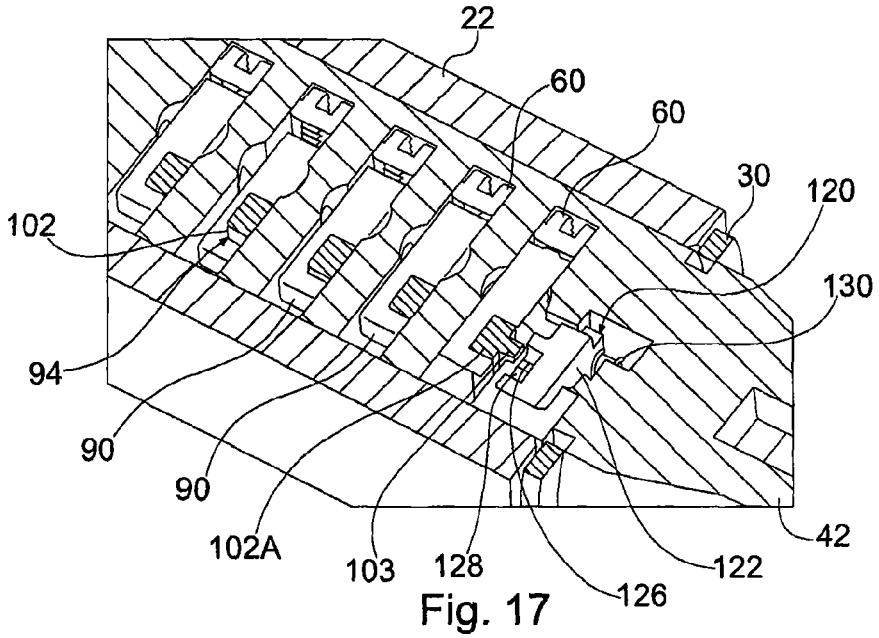
FIG. 17 is a top down cross-sectional view of the lock cylinder assembly with a reset key positioned in the keyway and the reset actuator moved to a reset position.
Figure 18:
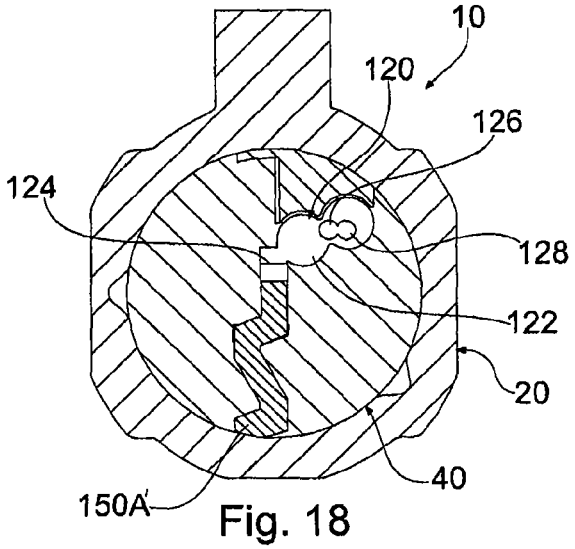
FIG. 18 is a cross-sectional view illustrating a reset key engaging the reset actuator.
Figure 19:
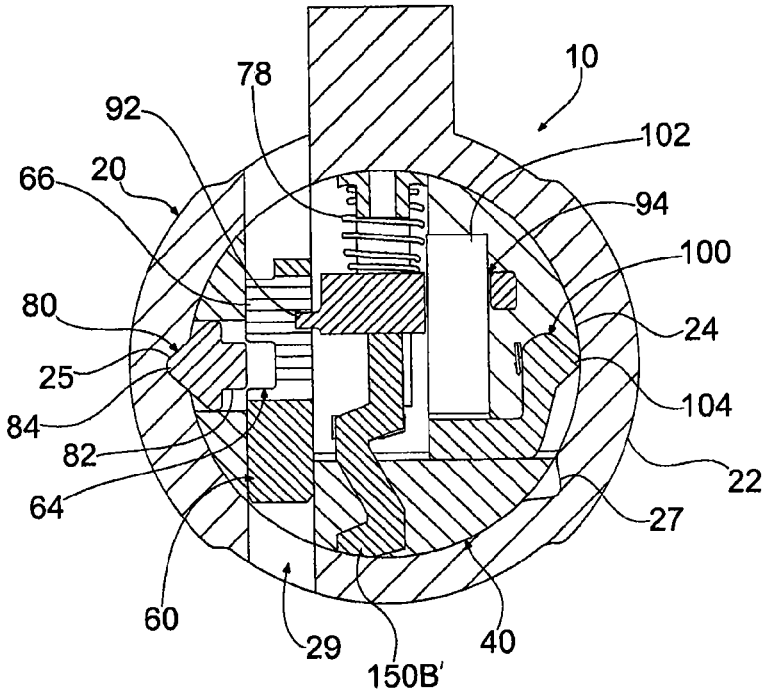
FIG. 19 is a cross-sectional view similar to FIG. 7 with a current reset key inserted into the lock cylinder assembly.

If a user desires to reprogram the lock cylinder assembly 10 without disassembling the lock cylinder assembly, the user may insert a proper reset key 150'. Insertion of the reset key 150' will cause the protruding tip 154' to engage the actuator reset contact 124 and thereby disengage the post 103 from the bore 126 as illustrated in FIGS. 15 and 17. As explained below, reprogramming of the lock cylinder assembly 10 requires rotation of the cylinder plug 40. As such, inserting an improper key, even if such engages the actuator reset contact 124, will not allow reprogramming because the improper key will not properly move the rack pins 60 and the cylinder plug 40 will not be rotatable.

Having generally described the components of the lock cylinder assembly 10, reprogramming thereof will now be described with reference to FIGS. 15-28. To reprogram the lock cylinder assembly 10, the user inserts a current reset key 150A' into the keyway as illustrated in FIGS. 15-19. By "current", it is meant that the reset key 150A' has a tooth and notch 152 configuration which matches the currently programmed configuration of the lock cylinder assembly 10. When the current reset key 150A' is inserted, the key 150A' engages each of the tongue pins 90 and moves the respective rack pins 60 to the unlock position shown in FIG. 19 wherein each notch 64 is aligned with the sidebar rail portion 82. The protruding tip 154' of current reset key 150A' also engages the actuator reset contact 124 and thereby disengages the reset actuator 120 from the post 103. Even though the reset actuator 120 is disengaged, the re-combinating sidebar 100 remains inward, and thereby maintains each tongue 92 engaged with the respective engagement passage 66, because the tapered bar 104 is in contact with the inside surface of the housing opening 24.

Figure 20:
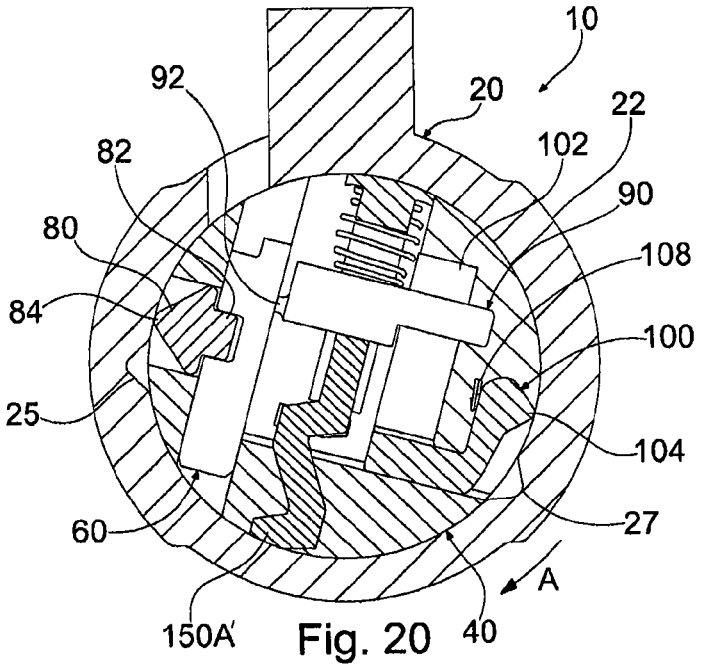
FIG. 20 is a cross-sectional view similar to FIG. 19 with the current reset key inserted into the lock cylinder assembly and the cylinder plug initially rotated.
Figure 21:
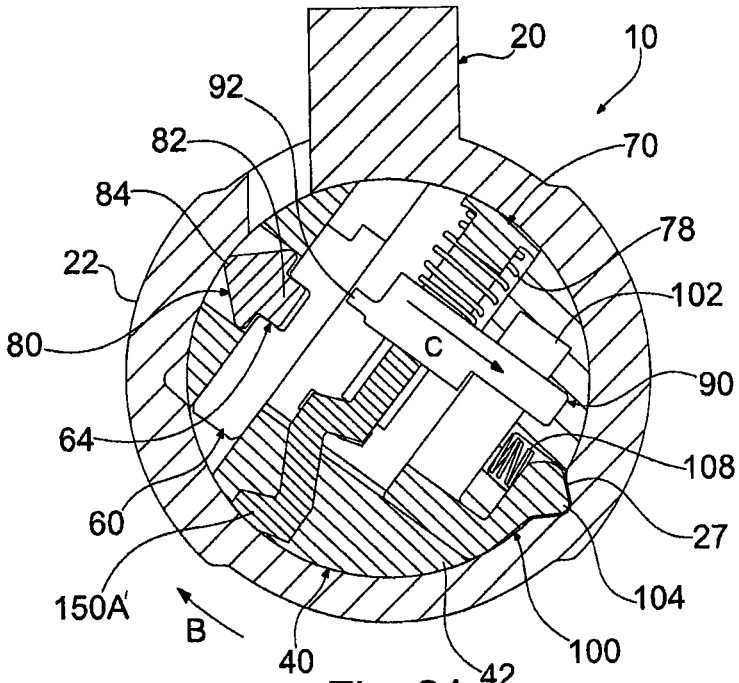
FIG. 21 is a cross-sectional view similar to FIG. 19 with the reset key inserted into the lock cylinder assembly and the cylinder plug rotated to a reset position.
Figure 22:
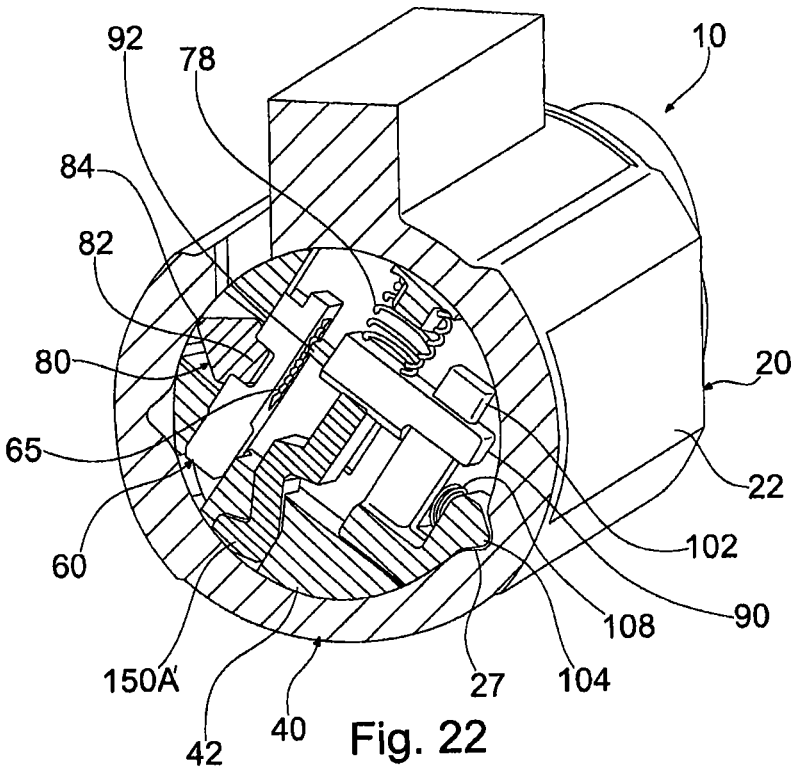
FIG. 22 is an isometric view of the lock cylinder assembly as shown in FIG. 21.

The current reset key 150A' is then rotated in the direction of arrow A in FIG. 20. While clockwise rotation is illustrated in the present embodiment, the invention is not limited to such. For example, the tapered groove 27 may be positioned in the upper right quadrant of the housing body 22, in which case the plug cylinder 40 would be rotated counter-clockwise for reprogramming, or in any other desired position. As with normal operation, the sidebar tapered portion 84 rides up the tapered groove 25 as the sidebar rail portion 82 is received in the notches 64. Rotation of the key and cylinder plug 40 in the direction of arrow B in FIG. 21 is continued until the tapered bar 104 is aligned with the tapered groove 27 in the housing 20. The springs 108 bias the re-combinating sidebar 100 radially outward as the tapered bar 84 enters the tapered groove 27. As the re-combinating sidebar 100 moves radially outward, each tongue pin 90 is also moved in the direction of arrow C in FIG. 21 such that the tongues 92 disengage from the respective engagement passages 66. The rack pins 60 stay aligned with the sidebar 80 based on the engagement of the rail portion 82 in each of the notches 64.

Figure 23:
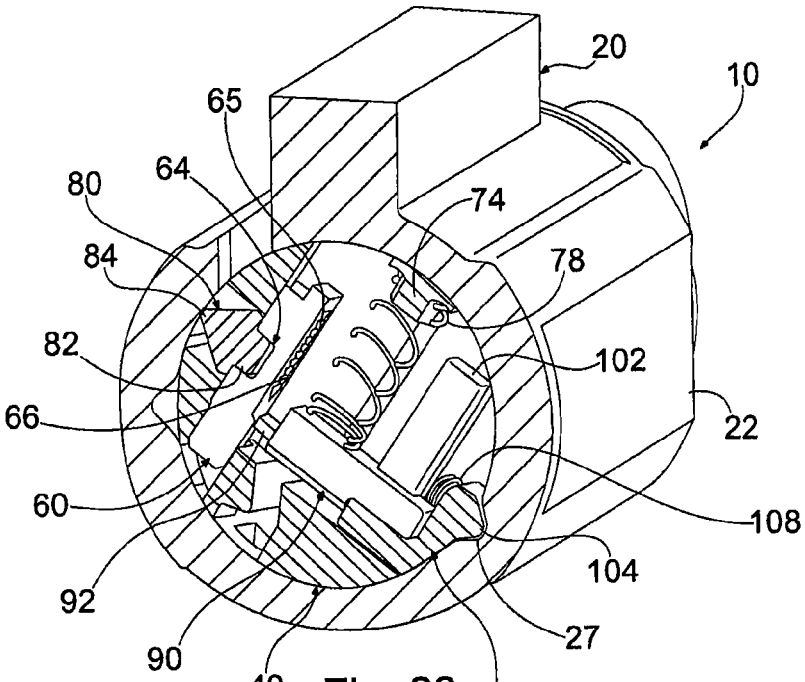
FIG. 23 is a cross-sectional view similar to FIG. 21 with the reset key removed.
Figure 24:
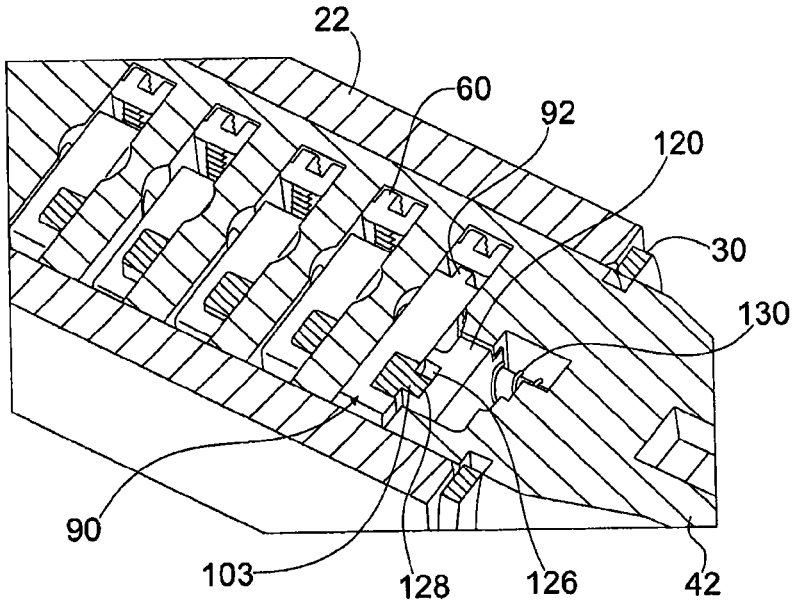
FIG. 24 is a top down cross-sectional view similar to FIG. 17 with the reset key removed and the reset actuator moved to a reset locked position.

Referring to FIGS. 23 and 24, the current reset key 150A' is removed whereby the top springs 78 bias the tongue pins 90 to a lower most position wherein the tongues 92 are not aligned with any of the engagement passages 66. Additionally, when the current reset key 150A' is removed, the actuator reset contact 124 is no longer engaged and the spring 130 biases the reset actuator 120 toward the re-combinating sidebar 100. With the re-combinating sidebar 100 in the outward reprogram position, the post 103 engages in the outer bore 128, thereby locking the re-combinating sidebar 100 in such outward reprogram position. This prevents a user from insert a regular user key (non-reset key) and trying to return the cylinder plug 40 to the home position. Additionally, because the tongues 92 do not align with any engagement passages, a user would not be able to insert an object into the keyway to try to bypass the reset actuator 120 as the tongues 92 would contact the body 62 of the rack pins 60 and prevent the re-combinating sidebar 100 from moving inward.

Figure 25:
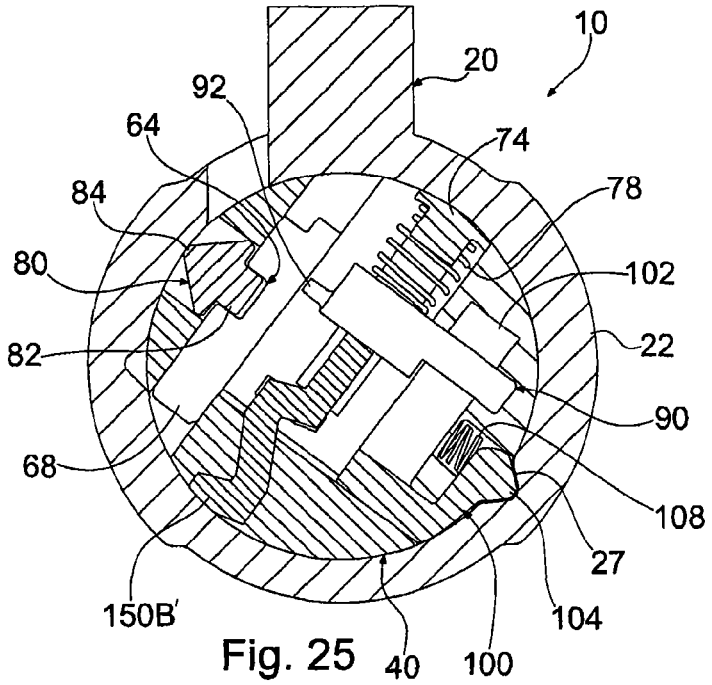
FIG. 25 is a cross-sectional view similar to FIG. 21 with a new reset key inserted into the lock cylinder assembly.
Figure 26:
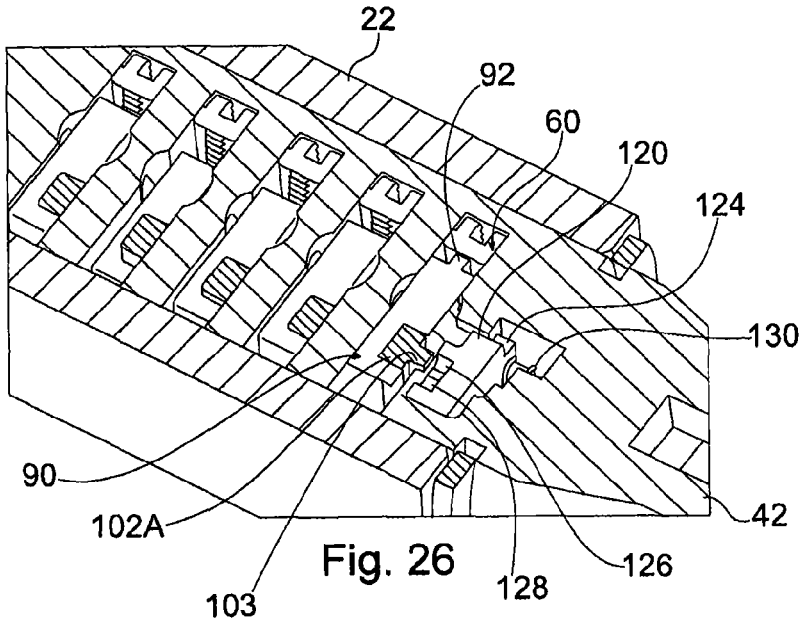
FIG. 26 is a top down cross-sectional view similar to FIG. 17 with the new reset key inserted and the reset actuator moved to the reset position.

To complete the reprogramming, it is necessary for the user to insert a new reset key 150B' as illustrated in FIGS. 25 and 26. By "new", it is meant that the reset key 150B' has a tooth and notch 152 configuration which matches the configuration of the intended or new user key to which the lock cylinder assembly 10 is to be programmed. When the new reset key 150B' is inserted, each of the tongue pins 90 is moved to a desired position relative to a respective rack pin 60. Additionally, the protruding tip 154' of the new reset key 150B' engages the actuator reset contact 124 and disengages the reset actuator 120.

Figure 27:
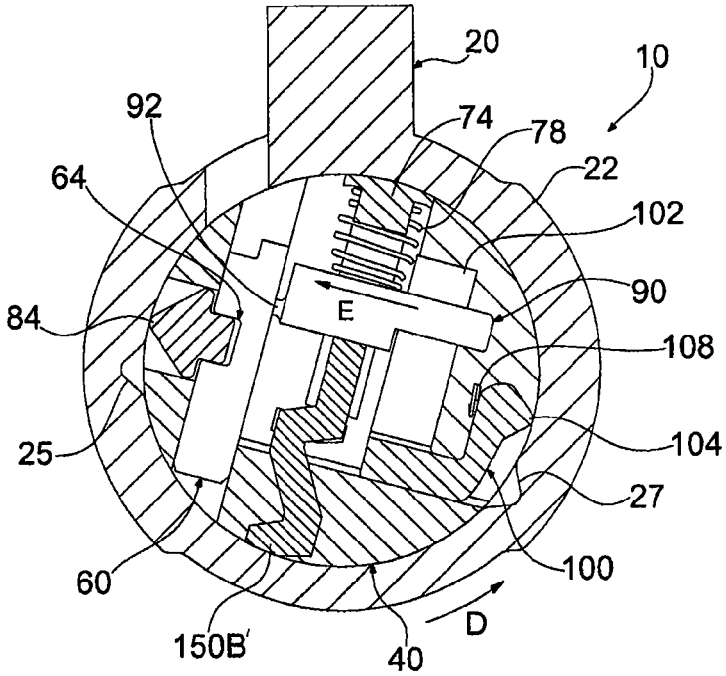
FIG. 27 is a cross-sectional view similar to FIG. 25 illustrating rotation of cylinder plug with the new reset key inserted therein from the reset position to the home position.

The new reset key 150B' is rotated in the reverse direction, as indicated by arrow D in FIG. 27, which causes the tapered bar 104 to ride up the tapered groove 27 and move the re-combinating sidebar 100 radially inward. As the re-combinating sidebar 100 moves radially inward, the tongue pins 90 move in the direction indicated by arrow E, thereby engaging each tongue 92 with a corresponding engagement passage 66 based on new reset key 150B' tooth and notch 152 configuration.

Figure 28:
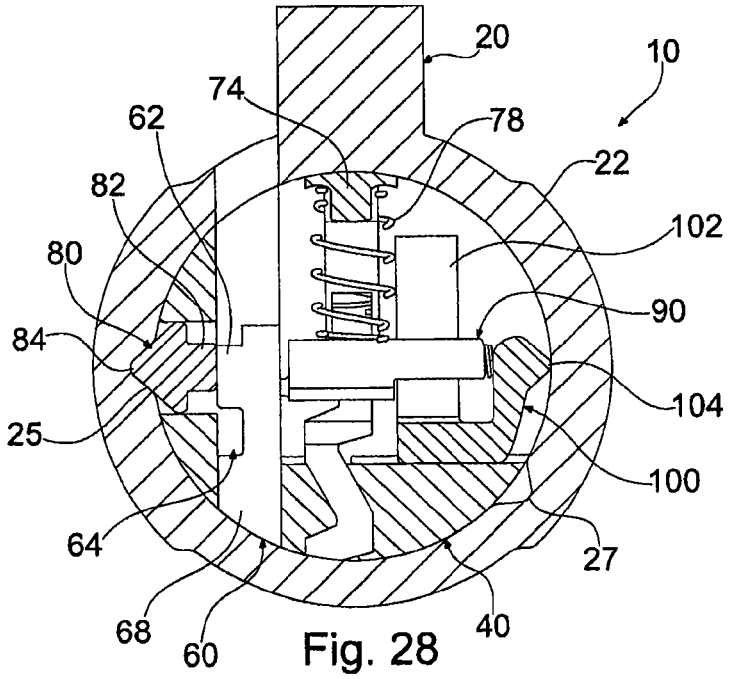
FIG. 28 is a cross-sectional view similar to FIG. 27 illustrating the reprogrammed cylinder plug in the home position with the new reset key removed.

Once the cylinder plug 40 is returned to the home position as illustrated in FIG. 28, the key 150B' is removed. Upon removal, the reset actuator 120 is biased toward the re-combinating sidebar 100 such that post 103 is received in bore 126, thereby locking the re-combinating sidebar 100 and the associated tongue pins 90 in position. The reprogrammed lock cylinder assembly 10 may thereafter be operated in a normal manner with user keys 150 having the new configuration.

A programmable lock cylinder assembly 210 in accordance with a second embodiment of the invention is illustrated and described with reference to FIGS. 29-55. Operation of the lock cylinder assembly 210 will be described with reference to non-master rack pins 60 and non-master sidebar 80, but generally operates in the same manner with the master rack pins 60A' and 60B' and the master locking sidebar 80'. Referring to FIGS. 29-38, the programmable lock assembly 210 generally comprises a lock housing 220 and a cylinder plug 240. The lock housing 220 includes a body 222 defining a generally tubular opening 224 extending the length thereof. The tubular opening 224 is configured to receive the cylindrical body 242 of the cylinder plug. Referring to FIG. 30, the cylinder plug 240 preferably extends out the opposite end of the housing 220 and is configured for connection to an output mechanism (not shown) for transmitting force from the cylinder plug 240 to one or more elements connected to the lock cylinder assembly 210. The output mechanism can take a number of different forms, including without limitation, a lever, drive shaft, coupling, cam, or other element mounted to the lock cylinder assembly 210. The present lock cylinder assembly may be utilized in any desired application. In the illustrated embodiment, a snap ring 230 engages a groove 246 in the cylinder body 242 to retain the lock cylinder assembly 210 in the assembled state illustrated in FIG. 30.

Figure 29:
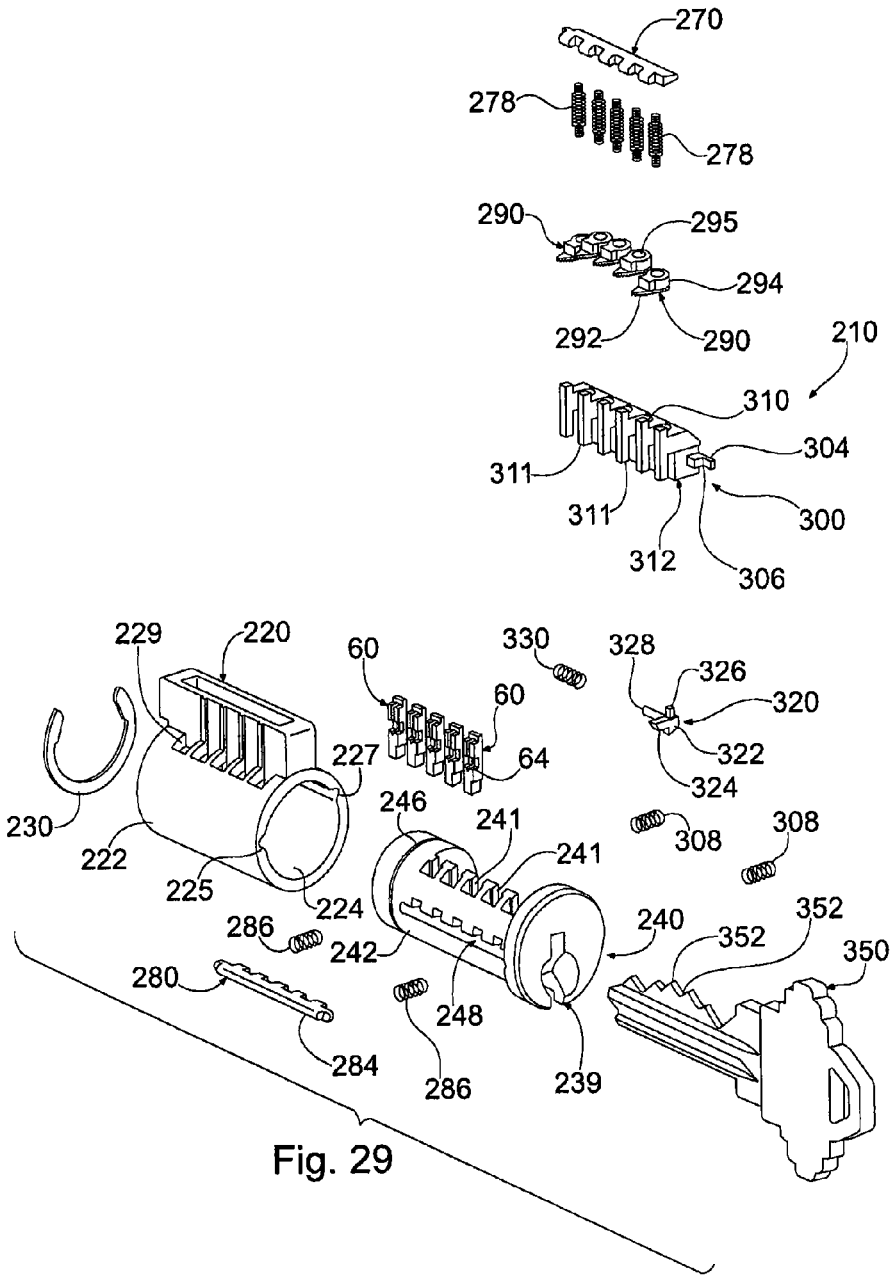
FIG. 29 is an exploded isometric view of a programmable lock cylinder assembly according to another embodiment of the invention.
Figure 30:
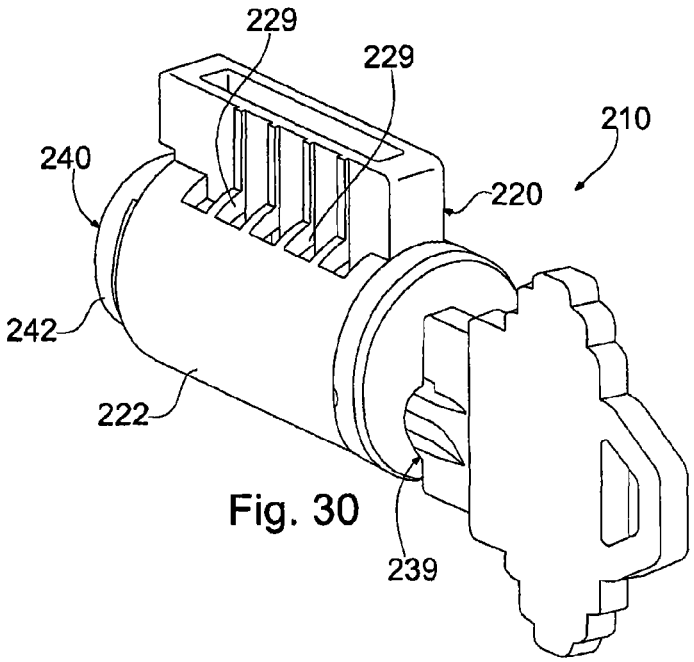
FIG. 30 is an assembled isometric view of the programmable lock cylinder assembly of FIG. 29 with a key inserted therein.
Figure 37:
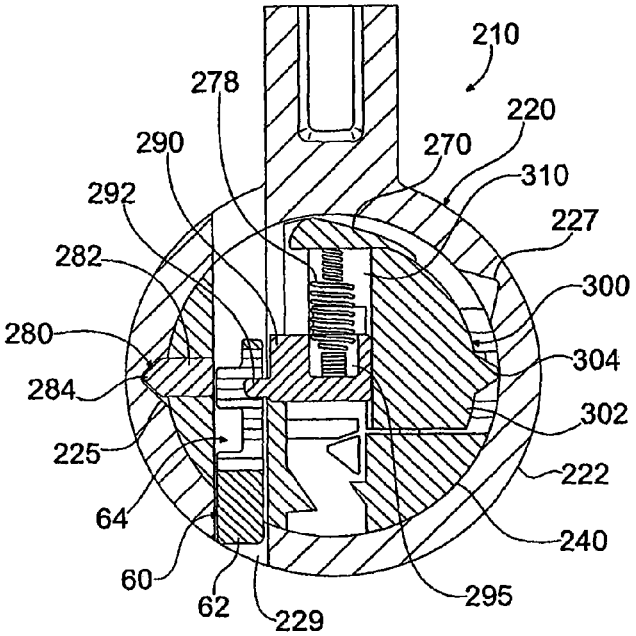
FIG. 37 is a cross-sectional view of the lock cylinder assembly of FIG. 29 in a home position.

Referring to FIGS. 29 and 37, the housing body 222 includes a pair of tapered grooves 225 and 227 extending along the inside surface of the opening 224. As in the previous embodiment, a sidebar 280 extends from the cylinder plug 240 and engages the tapered groove 225 to maintain the cylinder plug 240 rotationally locked relative to the housing 220 unless a proper key is positioned in the keyway 239 of the cylinder plug 240. The tapered groove 227 facilitates reprogramming of the lock cylinder assembly 210, as described in more detail hereinafter.

Figure 31:
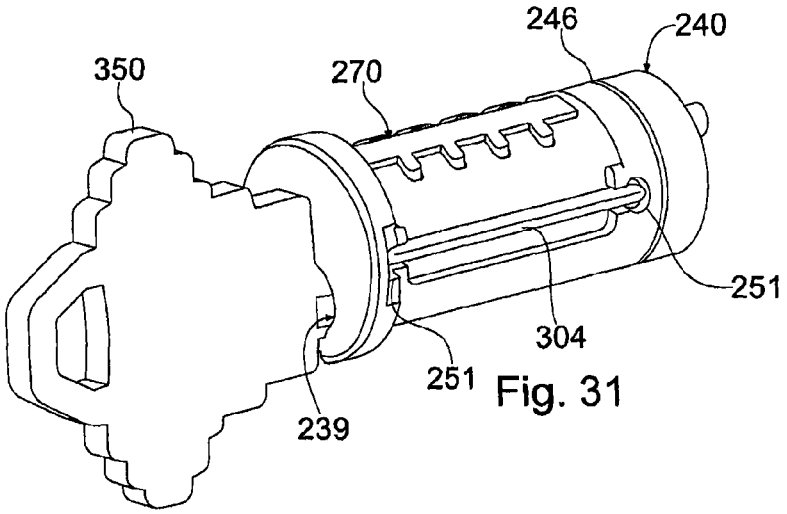
FIG. 31 is an isometric view similar to FIG. 30 with the lock housing removed.
Figure 31A:
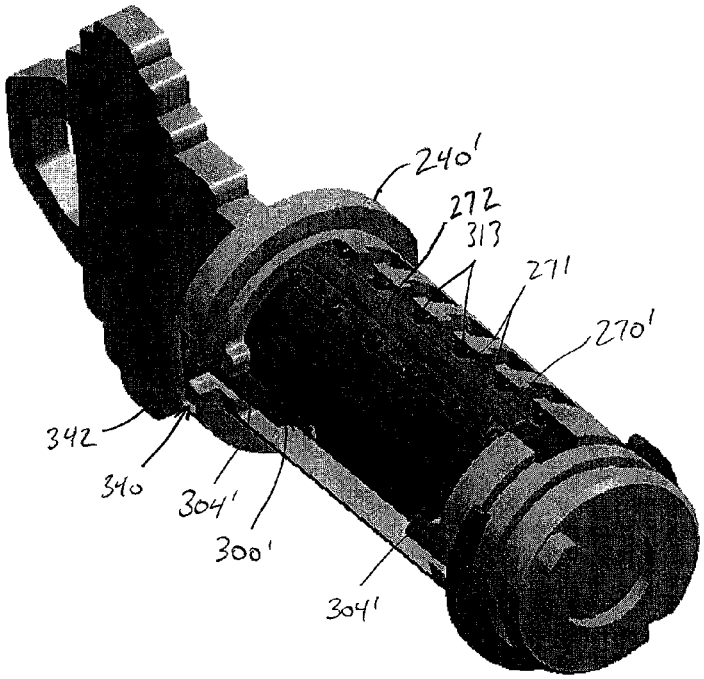
FIG. 31A is an isometric view similar to FIG. 30 illustrating an alternative lock cylinder plug.
Figure 38:
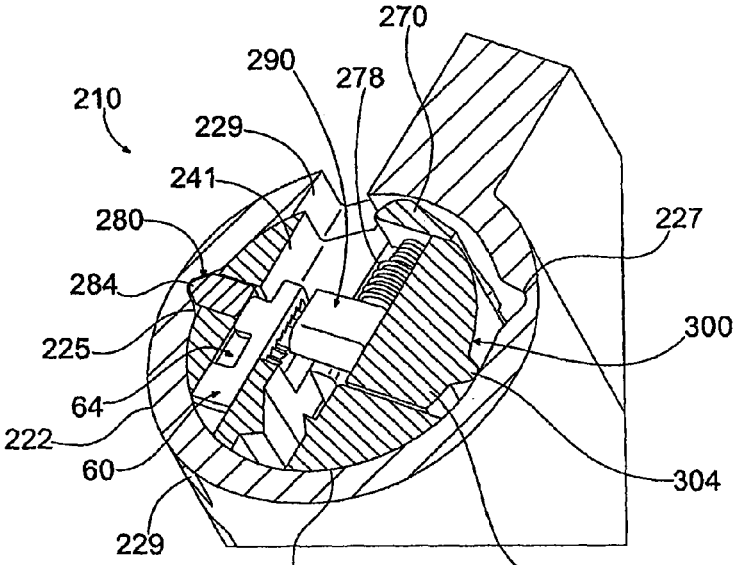
FIG. 38 is an isometric view of the lock cylinder assembly as shown in FIG. 37.

Referring to FIGS. 29 and 38, the housing body 222 may include a plurality of through bores 229 which align with rack pin bores 241 of the cylinder plug 240 when the cylinder plug 240 is positioned in a home position. The through bores 229 are configured to receive a portion of an associated rack pin 60, as described hereinafter, to further maintain the cylinder plug 240 rotationally locked relative to the housing 220 unless a proper key is positioned in the keyway 239 of the cylinder plug 240. Desirably, through bores 229 are provided on the upper and lower surfaces, in the illustrated orientation, such that the lock cylinder assembly 210 may be provided with upper and lower rack pins, if desired, for operation with a key having teeth on its upper and lower surfaces. FIGS. 31A and 36A illustrate an alternative cylinder plug 240' including a radial opening 340 on each side of the keyway 239. The radial openings 340 are aligned with the sidebar openings 243, 248, as described below, and are configured to receive antidrill plates 342. The antidrill plates 342 are desirably manufactured from a harder material which prevents drilling through the cylinder plug 240 to access either of the sidebars 280, 300.

Referring to FIGS. 29, 32, 34 and 38, the rack pin bores 241 extend substantially parallel to the keyway 239 of the cylinder plug 240. Each rack pin bore 241 is configured to receive and guide the axial movement of a rack pin 60. The rack pins 60 are substantially the same as the rack pins 60 of the previous embodiment as shown in FIG. 9. Each rack pin bore 241 desirably extends completely through the cylinder plug 240 such that the associated rack pin 60 may be configured to be moved upward or downward into engagement with an associated through bore 229, however, such is not required. Alternatively, the rack pin bores 241 may only extend from one surface of the cylinder plug body 242, or may even be completely internal within the cylinder plug body 242 such that the rack pins do not extend from the cylinder plug 240.

Referring to FIGS. 29, 32, 34 and 35, a sidebar opening 248 extends through a side surface of the cylinder body 242 in communication with the rack pin bores 241. The sidebar opening 248 is sized to receive a sidebar 280 such that a tapered portion 284 of the sidebar 280 is radially extendable from the cylinder plug 240. In the home position illustrated in FIG. 37, the tapered portion 284 extends from the cylinder plug 240 and is engaged in the tapered groove 225 to rotationally lock the cylinder plug 240 relative to the housing 220. One or more springs 286 are positioned between a rail portion 282 of the sidebar 280 and internal portions 249 of the cylinder body 242 to bias the sidebar radially outward.

Figure 37A:
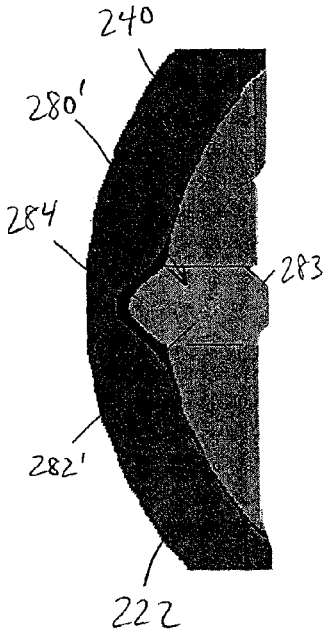
FIG. 37A is an expanded view of a portion of the lock cylinder assembly showing an alternative embodiment of the sidebar.
Figure 39:
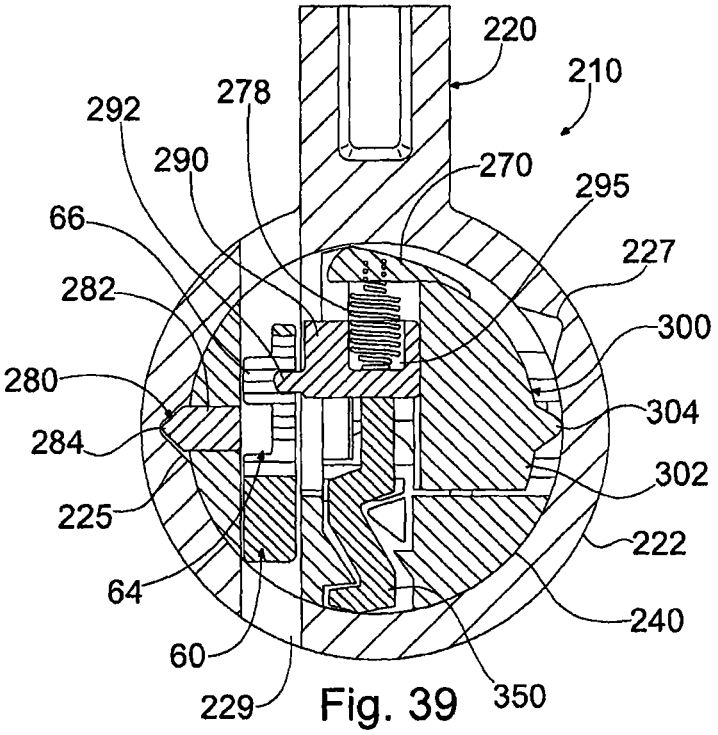
FIG. 39 is a cross-sectional view similar to FIG. 37 with a key inserted into the lock cylinder assembly.

The sidebar 280 is prevented from being moved radially inward, and thereby unlocking the lock, by the rack pins 60 unless a proper key is positioned in the keyway 239. The rack pins 60 of the present embodiment have the same configuration as the exemplary rack pin 60 illustrated in FIG. 9, but may have other configurations. As explained above, each rack pin 60 also includes a sidebar notch 64 configured to receive the rail portion 282 of the sidebar 280. As illustrated in FIG. 37, the rack pin body 62 generally has a thickness such that the rack pin body 62 contacts the sidebar rail portion 282 and prevents radial movement of the sidebar 280. When a proper key 350 is inserted in the keyway 239, the rack pin 60 is moved axially, as described below, such that the sidebar notch 64 is aligned with the sidebar rail portion 282 as shown in FIG. 39. With each rack pin 60 so aligned, the sidebar 280 is movable radially inward. Referring to FIG. 37A, an alternative sidebar 280' is illustrated. The alternative sidebar 280' operates in the same manner, but includes a chamfer 283 along the inner edge of the rail 282'. The chamfer 283 aids receipt of the sidebar 280' in the sidebar notches 64.

Figure 41:
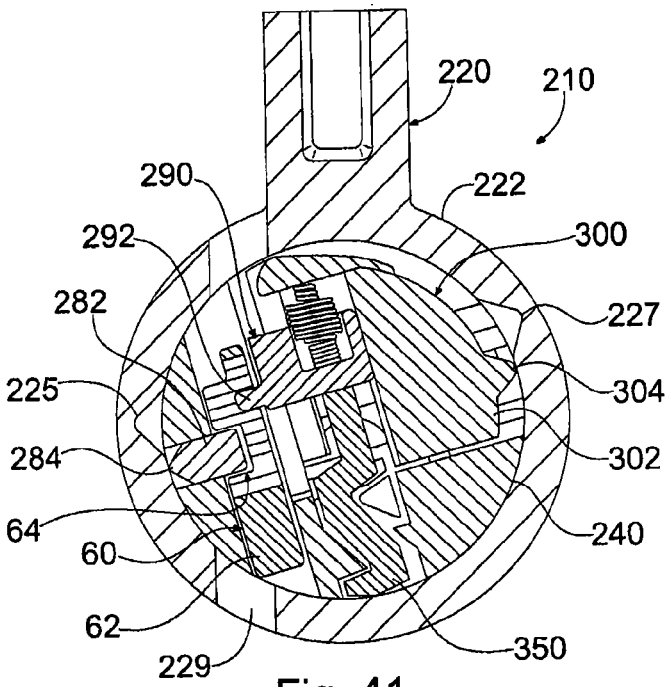
FIG. 41 is a cross-sectional view similar to FIG. 37 with a key inserted into the lock cylinder assembly and the cylinder plug rotated to an unlock position.

In the present embodiment, the sidebar 280 does not automatically move radially inward, but instead is biased radially outward as explained above. Referring to FIG. 41, with the proper key 350 inserted, the rack pins 60 are disengaged from the through bores 229 and the sidebar notches 64 are properly aligned, such that rotation of the key 350 causes the tapered portion 284 of the sidebar 280 to ride up the tapered groove 225 as the sidebar rail portion 282 is received in the notches 64. The lock cylinder assembly 210 is in an unlocked condition such that the cylinder plug 240 is rotatable relative to the housing 220. Rotation of the cylinder plug 240 actuates the output mechanism. When the key 350 is rotated back to the home position, the sidebar 280 automatically extends radially into engagement with the tapered groove 225. When the key 350 is removed, the rack pins 60 return to the home position wherein the notch 64 is no longer aligned with the sidebar rail portion 282 and the sidebar 280 is prevented from moving radially inward.

To facilitate axial movement of the rack pins 60 in response to an inserted key, each rack pin 60 is associated with a tongue pin 290 which extends perpendicular to the rack pin 60 across the keyway 239. Each tongue pin 290 includes a tongue 292 that is selectively engagable with one of the engagement passages 66 of the rack pin 60 through an opening 65 in the back of the rack pin 60 (see FIG. 36). In the present embodiment, the engagement passages 66 have a serrated configuration and the tongues 292 have a corresponding inverted triangular configuration, however, other complementary configurations may also be utilized.

In the present embodiment, each tongue pin 290 has a circular body portion 294 opposite the tongue 292. The circular body portion 294 is configured to be received in a corresponding circular bore 310 of the re-combinating sidebar 300 as described hereinafter. The corresponding circular configurations guide the tongue pins 290 as they move up and down in the bores 310. Other corresponding shapes other than circular may also be utilized.

Figure 32:
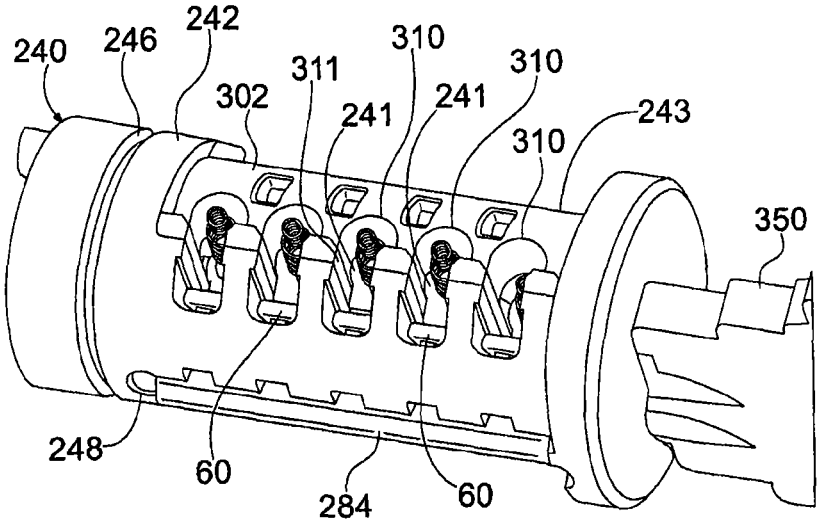
FIG. 32 is a left, top isometric view of the lock cylinder plug with the housing removed.
Figure 33:
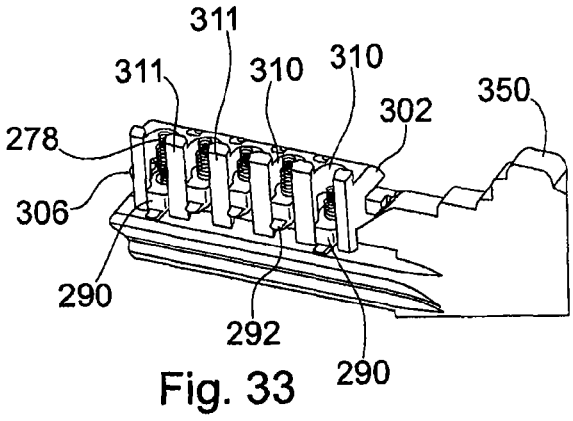
FIG. 33 is an isometric view of a key with a re-combinating sidebar and tongue pins of the present embodiment positioned relative thereto.
Figure 34:
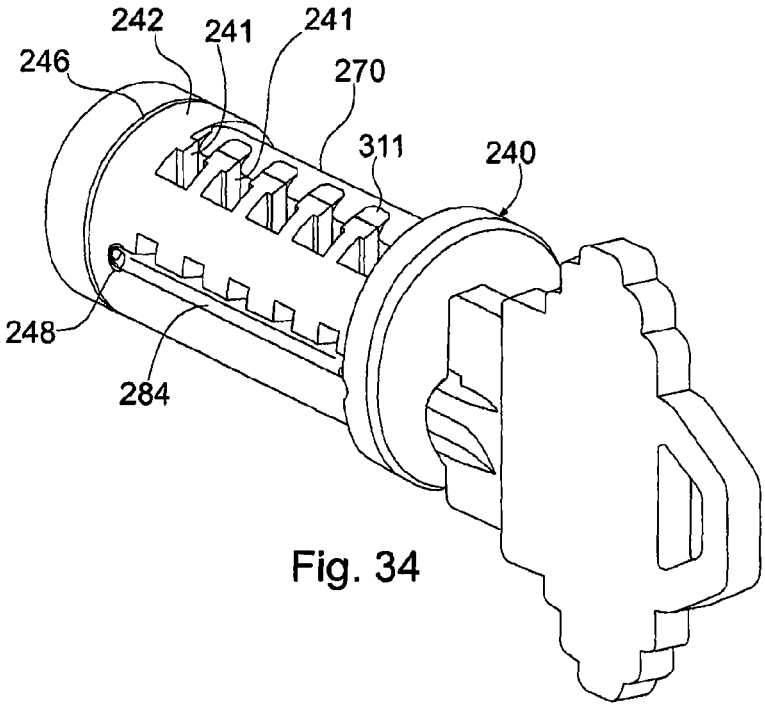
FIG. 34 is a left-side isometric view of the lock cylinder.
Figure 35:
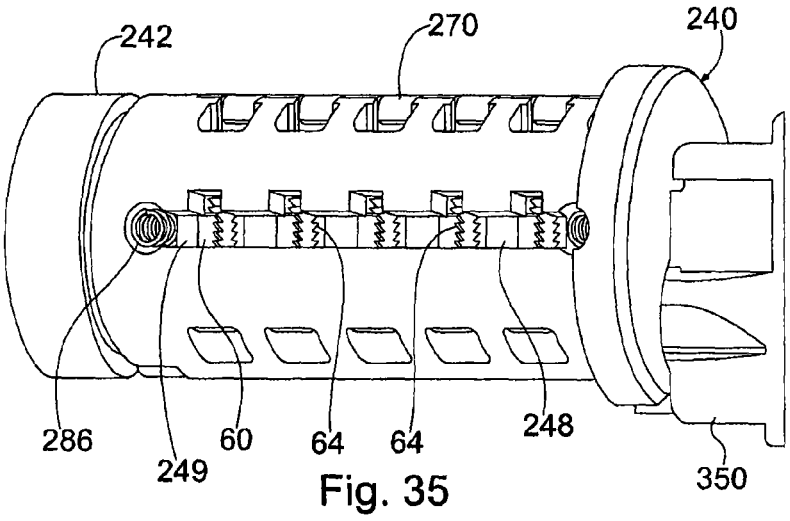
FIG. 35 is a left-side isometric view of the lock cylinder plug with the locking sidebar removed.
Figure 36:
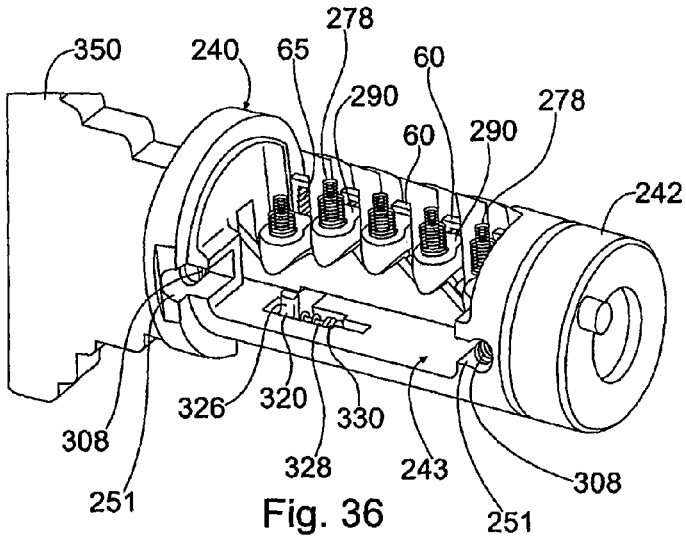
FIG. 36 is a right-side isometric view of the lock cylinder plug with the re-combinating sidebar removed.
Figure 36A:
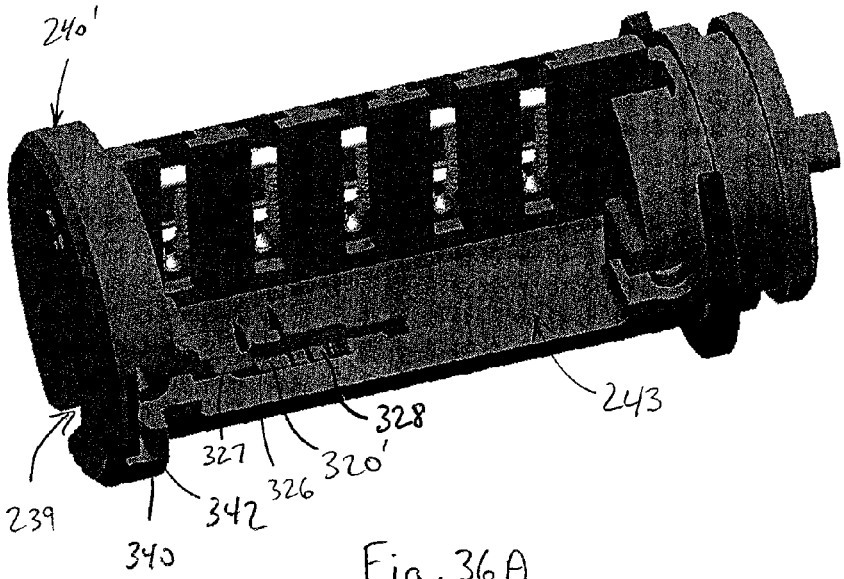
FIG. 36A is a right-side isometric view of an alternative lock cylinder plug with the re-combinating sidebar removed.

Referring to FIGS. 36 and 37, a detent 295 is provided in each circular body portion 294 and is configured to receive a spring 278 or the like extends between a top cover 270 and the respective tongue pin 290 to bias the tongue pin 290 downward. When the tongue pin 290 is engaged with a corresponding rack pin 60, the spring 278 thereby biases the rack pin 60 toward the locked position wherein the rack pin end 68 extends into the housing though bore 229 and the notch 64 is not aligned with the sidebar rail portion 282. Referring to FIG. 31A, an alternative configuration of the top cover 270' is illustrated. The top cover 270' includes notches 271 configured to receive corresponding projections 313 on the re-combinating sidebar 300'. To secure the top cover 270', the projections 313 may be staked to the cover 270'. The top cover 270' also includes a rounded central portion 272. As shown in FIG. 32, the cylinder body 242 desirably includes an open area 243 configured to receive the body of the re-combinating sidebar 300 which includes the bores 310.

In the present embodiment, the re-combinating sidebar 300 is utilized to control the selective engagement between the tongue 292 and the engagement passage 66, as described in more detail below. Referring to FIGS. 29, 32, 33 and 37, the re-combinating sidebar 300 includes a body portion 302 which defines the bores 310. A key contact surface 311 is provided between each adjacent pair of the bores 310, the key contact surfaces 311 spaced from the body portion 302 such that a sidebar keyway 312 is defined between the contact surfaces 311 and the body portion 302, as shown in FIG. 29. The tongue pins 290 extend across the sidebar keyway 312 such that they are engaged when a key 350 is inserted therein. A tapered bar 304 extends perpendicular from the body portion 302 opposite the bores 310. Referring to FIG. 31A, the tapered bar 304' of alternative re-combinating sidebar 300' does not extend the length thereof, but instead is provided in two segments. Guide members 306 extend from each end of the body portion 302 and are configured to be received in guide slots 251 in the cylinder body 242 (see FIG. 36). Positioning of the guide members 306 in the respective guide slots 251 guides radial movement of the re-combinating sidebar 300. The tapered bar 304 extends radially outwardly from the open area 243 of the cylinder plug 240. A spring 308 or the like is positioned within each guide slot between the cylinder body 242 and the tapered bar 304 such that the re-combinating sidebar 300 is biased radially outward.

Figure 42:
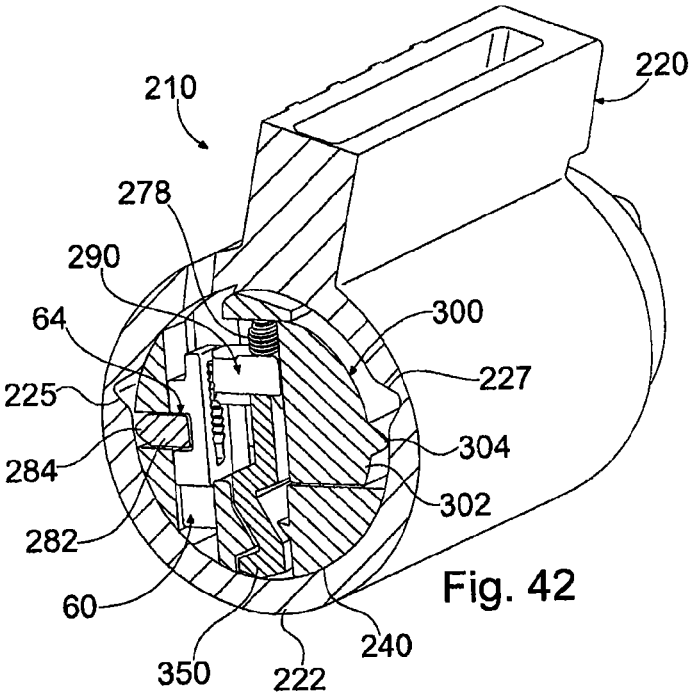
FIG. 42 is an isometric view of the lock cylinder assembly as shown in FIG. 41.

Referring to FIG. 37, during normal operation, the re-combinating sidebar 300 is maintained in a radially inward position by engagement of the tapered bar 304 with the inside surface 224 of the housing 220. In the radially inward position, each tongue 292 of the tongue pins 290 remains engaged with the intended engagement passage 66 of the corresponding rack pin 60. With reference to FIGS. 41 and 42, even if a user key 350 is inserted into the keyway 239 and the cylinder plug 230 is rotated, for example, to a position where the tapered bar 304 is circumferentially aligned with the tapered groove 227, contact of the key contact surfaces 311 of the sidebar 300 against the shank of the user key 350 prevents the sidebar 300 from moving radially outward, thereby maintaining the sidebar 300 in the normal operation mode. As will be described in more detail hereinafter, the reset key 350' has a thinned shank portion, such that a clearance is defined between the key shank 351' and the key contact surfaces 311 and the sidebar 300 is free to be urged radially outward, thereby disengaging the tongue pins 290 from the rack pins 60.

Figure 50:
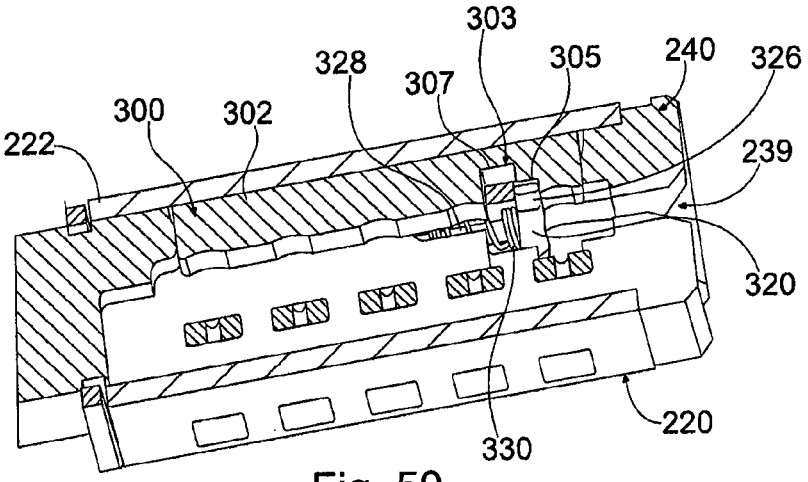
FIG. 50 is a top down cross-sectional view of the lock cylinder assembly with a reset key positioned in the keyway and the reset actuator moved to a reset position.
Figure 53:
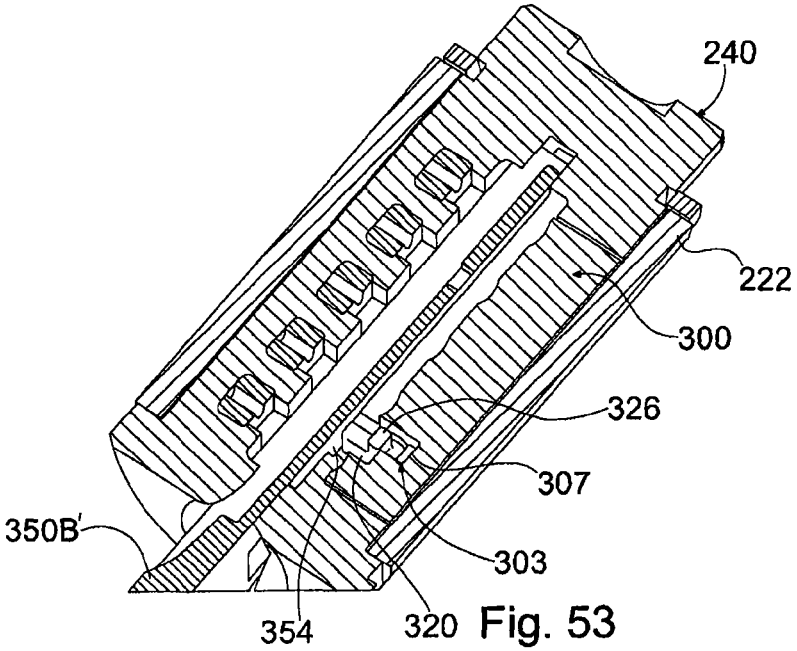
FIG. 53 is a top down cross-sectional view similar to FIG. 51 with the new reset key inserted and the reset actuator moved from the locked reset position.

Referring to FIGS. 29, 36, 50 and 51, a reset actuator 320 is positioned between the cylinder plug 240 and the sidebar 300 and is configured to maintain the sidebar 300 in a radially outward position during resetting. The reset actuator 320 includes an actuator body 322 with a reset contact 324 extending therefrom. An upper surface of the actuator body 322 includes a block 326 configured to engage a portion of the sidebar 300. A post 328 extends from the actuator body 322 and is configured to receive a spring 330 or the like such that the reset actuator 320 is spring biased within a groove in the plug cylinder 240, as shown in FIG. 36. Referring to FIG. 36A, an alternative reset actuator 320' is illustrated and includes a stabilizing leg 327 extending opposite to the post 328 to stabilize the reset actuator 320'. As shown in FIGS. 50 and 53, the sidebar body portion 302 includes a notch 303 which defines a radially inner shoulder 305 and a radially outer shoulder 307. The block 326 engages the inner shoulder 305 when the sidebar 300 is locked in the resetting position as will be described. The spring 330 or the like biases the actuator 320 to this position once the cylinder plug 240 has been rotated to the reset position by an appropriate reset key and the sidebar 300 has been moved radially outward. The reset actuator 320 is biased toward engagement with the inner shoulder 305 until a proper reset key 350' is positioned in the keyway 239.

Figure 45:
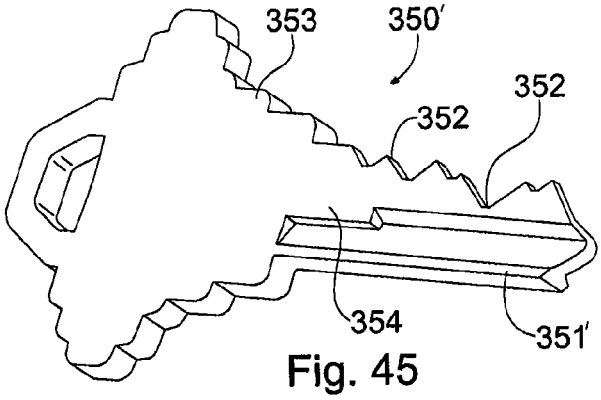
FIG. 45 is an isometric view of a reset key.
Figure 46:
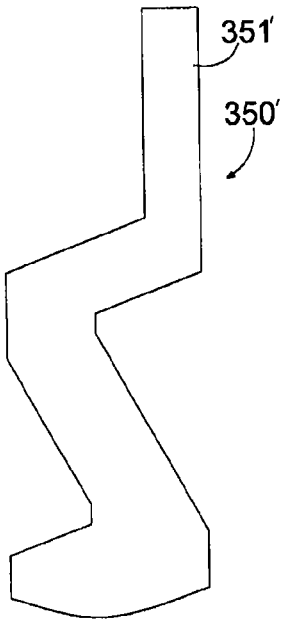
FIG. 46 is an end elevation view of the reset key of FIG. 45.
Figure 47:
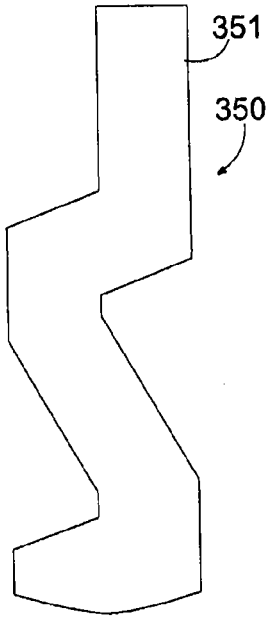
FIG. 47 is an end elevation view similar to FIG. 46 and illustrating the configuration of a user key.
Figure 48:
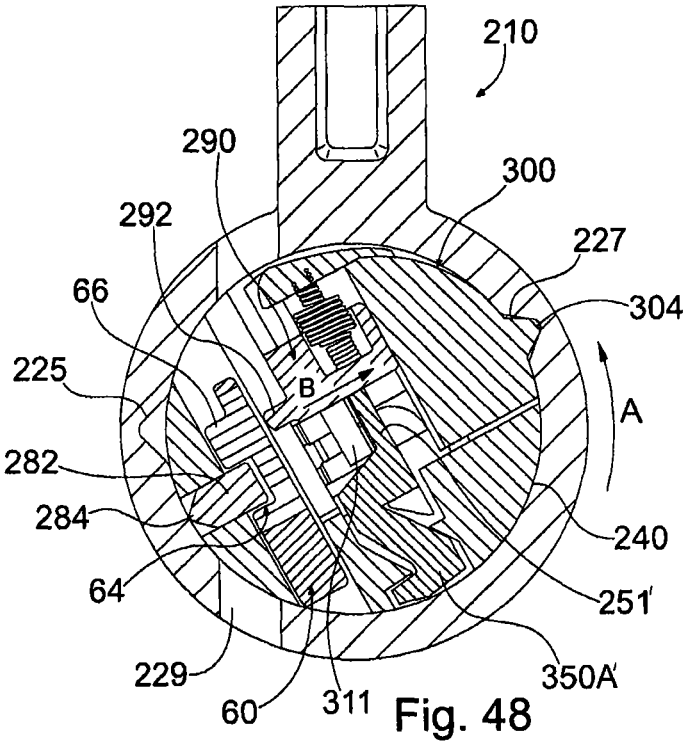
FIG. 48 is a cross-sectional view similar to FIG. 44 with the current reset key inserted into the lock cylinder assembly and the cylinder plug rotated to a reset position.
Figure 51:
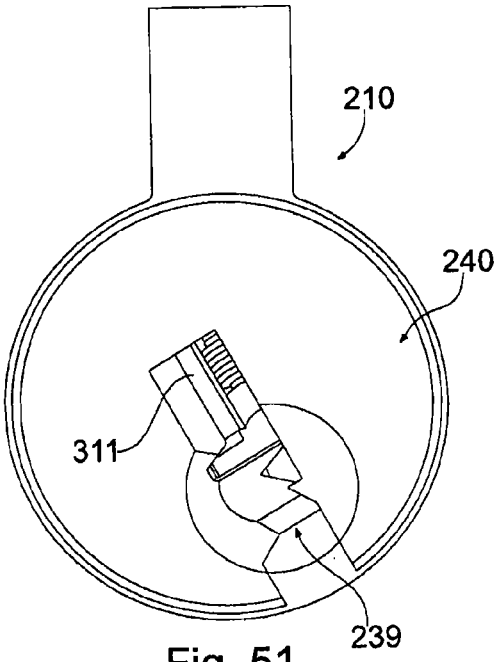
FIG. 51 is an end view of the lock cylinder assembly of FIG. 50.

Referring to FIGS. 45-47, the present embodiment of the invention utilizes two distinct types of keys, namely a user key 350 and a reset key 350'. Both keys 350, 350' include a plurality of teeth and notches 352, but the reset key 350' includes a protrusion 354 adjacent where the key shank 351' meets the key head 353. Additionally, as explained above, the shank 351 of the user key 350 is thicker compared to the shank 351' of the reset key 350' such that the user key 350 does not allow the sidebar 300 to move radially outward. Additionally, due to the thicker shank 351 of the user key 350, the key contact surface 311 will block entry of a user key 350 when the cylinder plug 240 is in the reset position as shown in FIG. 51.

Having generally described the components of the lock cylinder assembly 210, normal operation and reprogramming thereof will now be described with reference to FIGS. 37-55. The lock cylinder assembly 210 is shown in FIGS. 37 and 38 in an originally assembled configuration with each tongue pin 290 engaged with a respective rack pin 60 such that a key biting is defined for each rack pin 60. In the locked position shown, the springs 278 bias the tongue pins 290, and thereby the rack pins 60 to a lower position wherein the sidebar rail portion 282 is misaligned with the rack pin notches 64. As such, the sidebar tapered portion 284 engages the tapered groove 225 and the rack pin body portions 62 engage the housing bores 229, thereby preventing rotation of the cylinder plug 240 relative to the housing 220.

Figure 40:
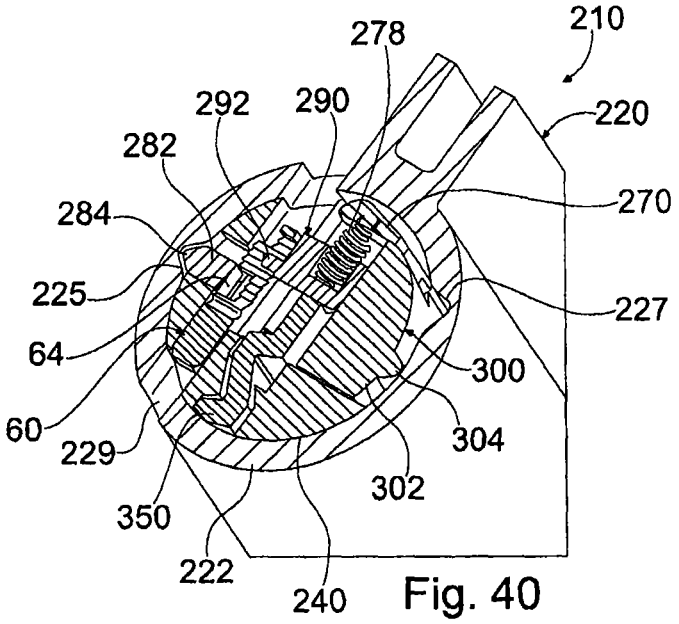
FIG. 40 is an isometric view of the lock cylinder assembly as shown in FIG. 39.

To operate the lock cylinder assembly 210 in normal operation, an appropriate user key 350 is inserted into the keyway 239 as shown in FIGS. 39 and 40. As the user key 350 is inserted, the teeth and notches 352 engage the respective tongue pins 290, thereby raising the rack pins 60 to an unlocked position wherein the notches 64 are all aligned with the sidebar rail portion 282 and the rack pin body portions 62 are disengaged from the housing bores 229.

Figure 43:
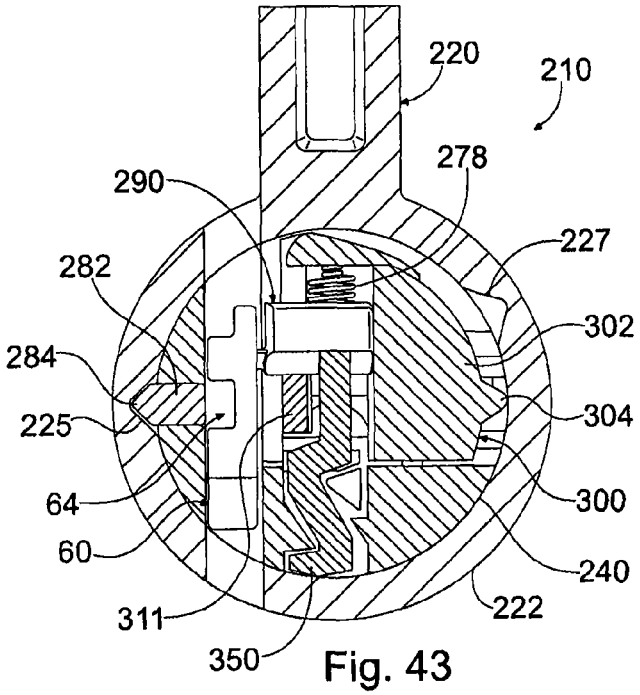
FIG. 43 is a cross-sectional view similar to FIG. 39 with a key inserted into the lock cylinder assembly.

The user then turns the user key 350 as illustrated in FIGS. 41 and 42. Since the sidebar rail portion 282 is aligned with the notches 64, the sidebar tapered portion 284 rides up the tapered groove 225 as the sidebar rail portion 282 is received in the notches 64. The plug cylinder 240 is freely rotated relative to the housing 220. As explained above, even if the plug cylinder 240 is rotated such that the tapered bar 304 is circumferentially aligned with the tapered groove 227, contact of the key contact surfaces 311 of the sidebar 300 against the shank 351 of the user key 350 prevents the sidebar 300 from moving radially outward, as shown in FIG. 43. As such, the tongue pins 290 are maintained in engagement with the rack pins 60.

Figure 44:
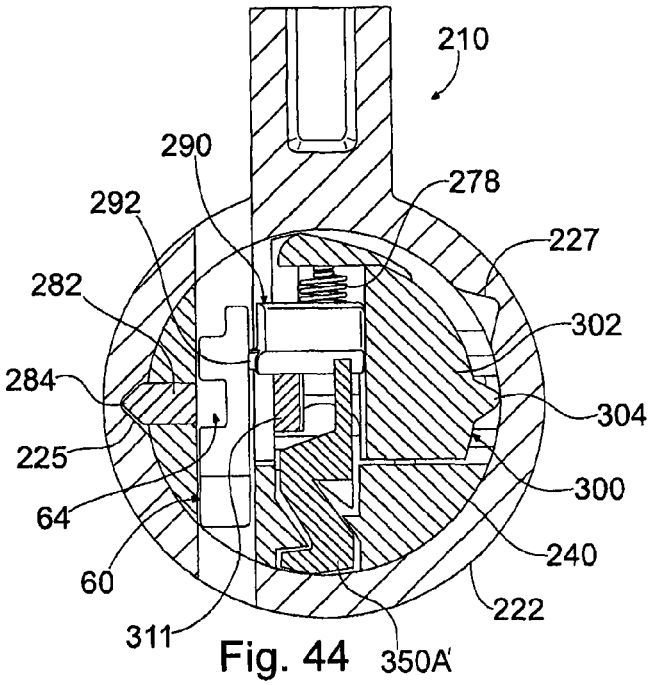
FIG. 44 is a cross-sectional view similar to FIG. 34 with a reset key inserted into the lock cylinder assembly.

If a user desires to reprogram the lock cylinder assembly 210 without disassembling the lock cylinder assembly, the user may insert a proper reset key 350' as shown in FIG. 44. As explained below, reprogramming of the lock cylinder assembly 210 requires rotation of the cylinder plug 240. As such, inserting an improper key, i.e. one not having the proper biting, will not allow reprogramming because the improper key will not properly move the rack pins 60 and the cylinder plug 240 will not be rotatable.

To reprogram the lock cylinder assembly 210, the user inserts a current reset key 350A' into the keyway. By "current", it is meant that the reset key 350A' has a tooth and notch 352 configuration which matches the currently programmed configuration of the lock cylinder assembly 210. When the current reset key 350A' is inserted, the key 350A' engages each of the tongue pins 290 and moves the respective rack pins 60 to the unlock position shown in FIG. 44 wherein each notch 64 is aligned with the sidebar rail portion 282. The current reset key 350A' is then rotated in the direction of arrow A in FIG. 48. While counterclockwise rotation is illustrated in the present embodiment, the invention is not limited to such, as illustrated above. As with normal operation, the sidebar tapered portion 284 rides up the tapered groove 225 as the sidebar rail portion 282 is received in the notches 64. Rotation of the key and cylinder plug 240 is continued until the tapered bar 304 is aligned with the tapered groove 227 in the housing 220. The springs 308 bias the re-combinating sidebar 300 radially outward as the tapered bar 304 enters the tapered groove 227. As the re-combinating sidebar 300 moves radially outward, each tongue pin 290 is also moved in the direction of arrow B in FIG. 48 such that the tongues 292 disengage from the respective engagement passages 66. The rack pins 60 stay aligned with the sidebar 280 based on the engagement of the rail portion 282 in each of the notches 64.

Figure 49:
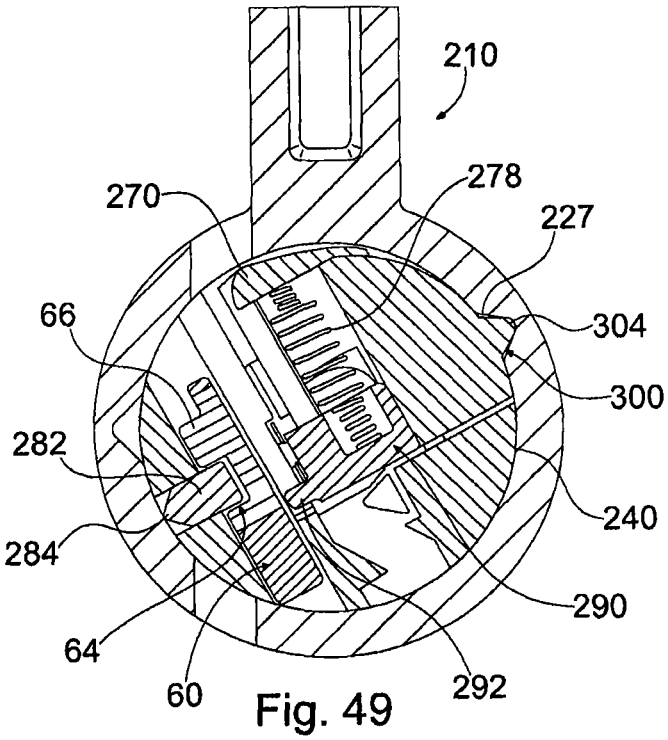
FIG. 49 is a cross-sectional view similar to FIG. 48 with the reset key removed.
Figure 52:
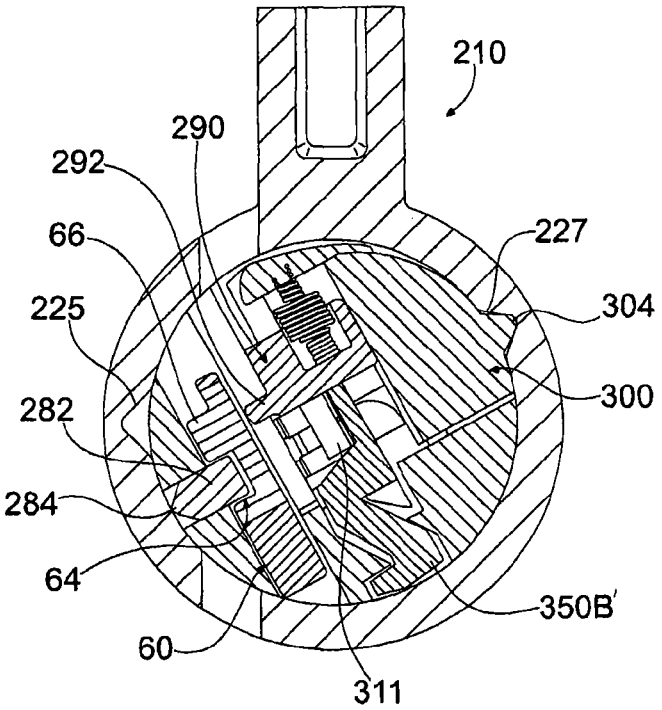
FIG. 52 is a cross-sectional view similar to FIG. 48 with a new reset key inserted into the lock cylinder assembly.

Referring to FIGS. 49 and 50, the current reset key 350A' is removed whereby the top springs 278 bias the tongue pins 290 to a lower most position wherein the tongues 292 are not aligned with any of the engagement passages 66. Additionally, as shown in FIG. 50, when the current reset key 350A' is removed, the reset actuator 320 is no longer engaged by the protrusion 354 of the reset key 350' and the spring 330 biases the reset actuator 320 such that the actuator block 326 engages the inner shoulder 305, thereby maintaining the re-combinating sidebar 300 in the radially outward, reprogram position. As explained above, a user is prevented from inserting a regular user key (non-reset key) and trying to return the cylinder plug 240 to the home position by the sidebar key contacting surfaces 311 extending within the keyway 239 as shown in FIG. 52. Additionally, because the tongues 292 do not align with any engagement passages, a user would not be able to insert an object into the keyway to try to bypass the reset actuator 320 as the tongues 292 would contact the body 62 of the rack pins 60 and prevent the re-combinating sidebar 300 from moving inward.

To complete the reprogramming, it is necessary for the user to insert a new reset key 350B' as illustrated in FIGS. 52 and 53. By "new", it is meant that the reset key 350B' has a tooth and notch 352 configuration which matches the configuration of the intended or new user key to which the lock cylinder assembly 210 is to be programmed. When the new reset key 350B' is inserted, each of the tongue pins 290 is moved to a desired position relative to a respective rack pin 60. Additionally, the protrusion 354 of the new reset key 350B' engages the actuator reset contact 324 and disengages the reset actuator block 326 from the inner shoulder 305, instead aligning the block 326 with the outer shoulder 307. Accordingly, the re-combinating sidebar 300 is free to move radially inward.

Figure 54:
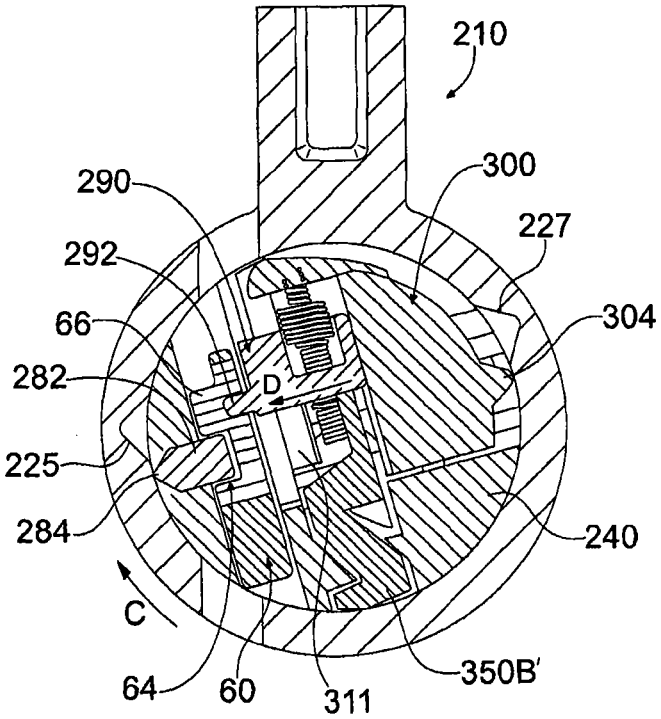
FIG. 54 is a cross-sectional view similar to FIG. 52 illustrating rotation of cylinder plug with the new reset key inserted therein from the reset position toward the home position.

The new reset key 350B' is rotated in the reverse direction, as indicated by arrow C in FIG. 54, which causes the tapered bar 304 to ride up the tapered groove 227 and move the re-combinating sidebar 300 radially inward. As the re-combinating sidebar 300 moves radially inward, the tongue pins 290 move in the direction indicated by arrow D, thereby engaging each tongue 292 with a corresponding engagement passage 66 based on new reset key 350B' tooth and notch 352 configuration.

Figure 55:
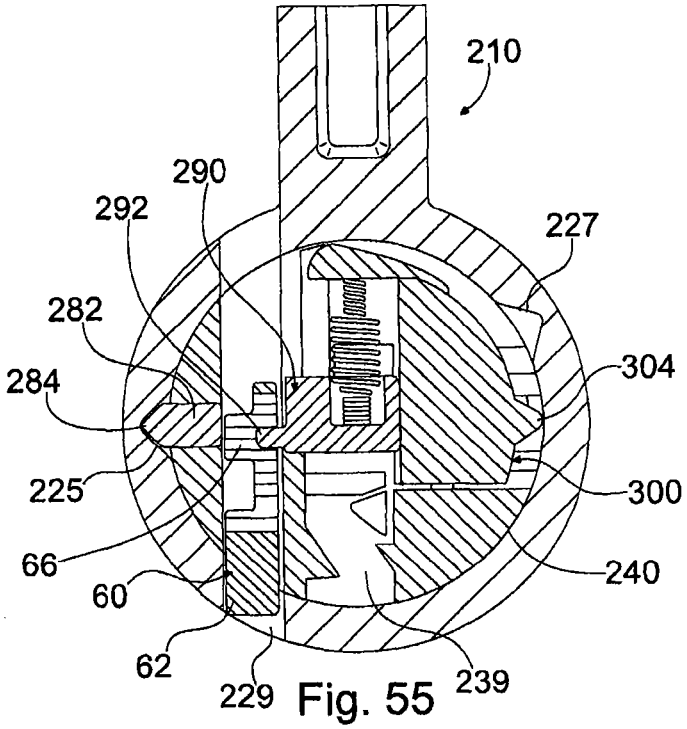
FIG. 55 is a cross-sectional view similar to FIG. 54 illustrating the reprogrammed cylinder plug in the home position with the new reset key removed.

Once the cylinder plug 240 is returned to the home position as illustrated in FIG. 55, the key 350B' is removed. Upon removal, the reset actuator 320 remains received within notch 303 against the outer shoulder 307 with the re-combinating sidebar 300 maintained in the radially inward position by contact of the tapered bar 304 against the housing inside surface 224. The reprogrammed lock cylinder assembly 210 may thereafter be operated in a normal manner with user keys 350 having the new configuration.

Having described illustrative reprogrammable lock cylinder assemblies useable with the current invention, the master keying system and method of the invention will now be described with reference to FIGS. 64-70.

To determine the available master keys, change keys and rekeys for a given master key system, the present invention utilizes a bitting list generator to calculate all of the available key cuts for the system. The bitting list generator is preferably a computer operated system which starts with a key bitting array (KBA) 430 and calculates all of the available key cuts based on the intended sequence of progression (SOP). An acceptable bitting list generator is a spreadsheet which is configured to calculate each key cut based on the KBA 30 and SOP and to identify any cuts which violate the MACS. Any other system capable of performing the necessary calculations and coordination of data may alternatively be utilized.

Figure 64:
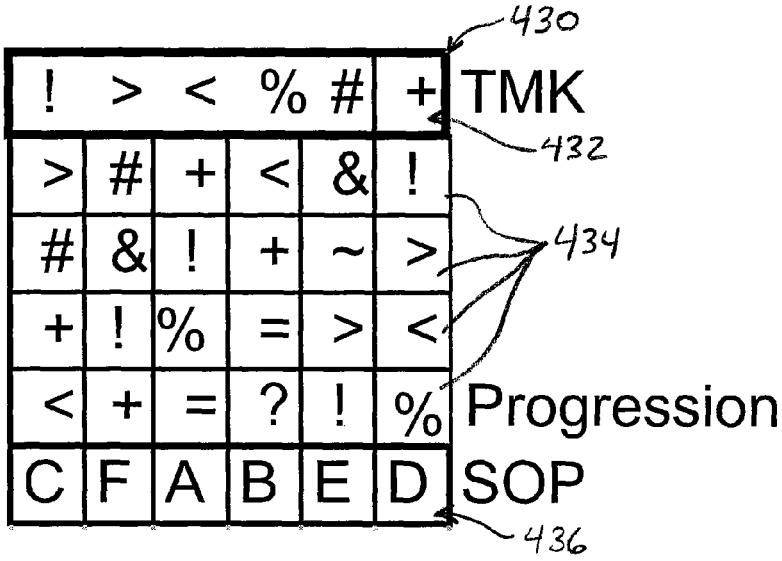
FIG. 64 illustrates an exemplary key bitting array.

An illustrative KBA 430 is shown in FIG. 64. The KBA 430, as well as the resultant output, are typically in the form of a sequence of numerical digits which correspond to key cut depths, however, various random symbols are used in the Figures as a specific KBA and corresponding key cuts are not necessary for an understanding of the invention.

A user enters a desired KBA 430 into the bitting list generator following general master keying rules and the intended SOP. In the illustrated KBA 430, the user begins by entering the top master key (TMK) cut sequence 432. The user will then check the KBA 430 to be sure the necessary sequencing rules have been adhered to, for example, there are no digits from the TMK 432 in the Progression Possibilities 434, that the Progression Possibilities 434 increment by a given number, and that the SOP 436 uses digits that do not reoccur. These are the requirements for this given master key system, but each master key system can have its own requirements in accordance with known master keying principals.

Figure 65A:
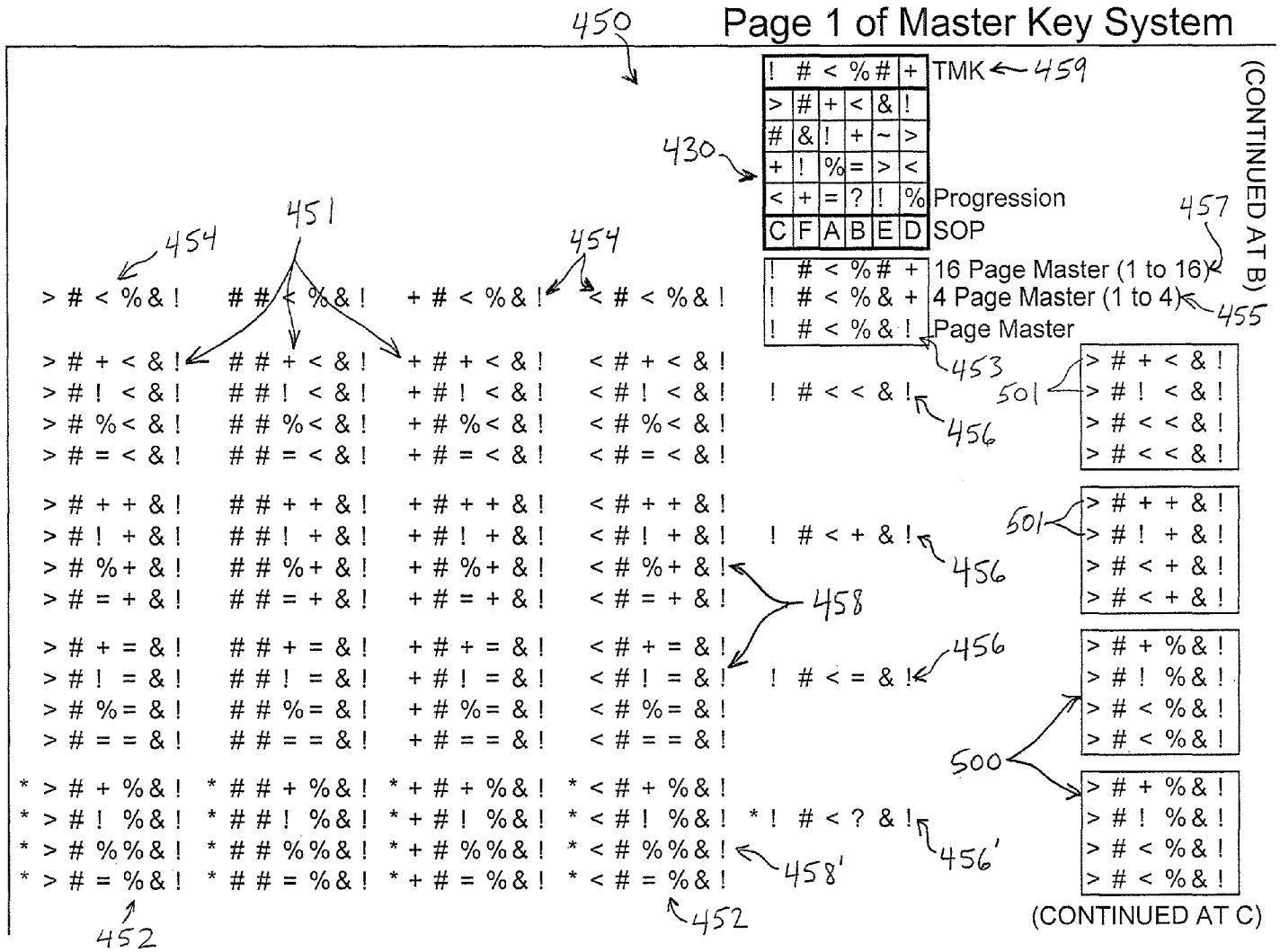
FIG. 65 is an illustrative page master listing of all key bitting combinations generated by the bitting list generator for a given page master key and the corresponding rekey matrices and master pin matrices.
Figure 65B:
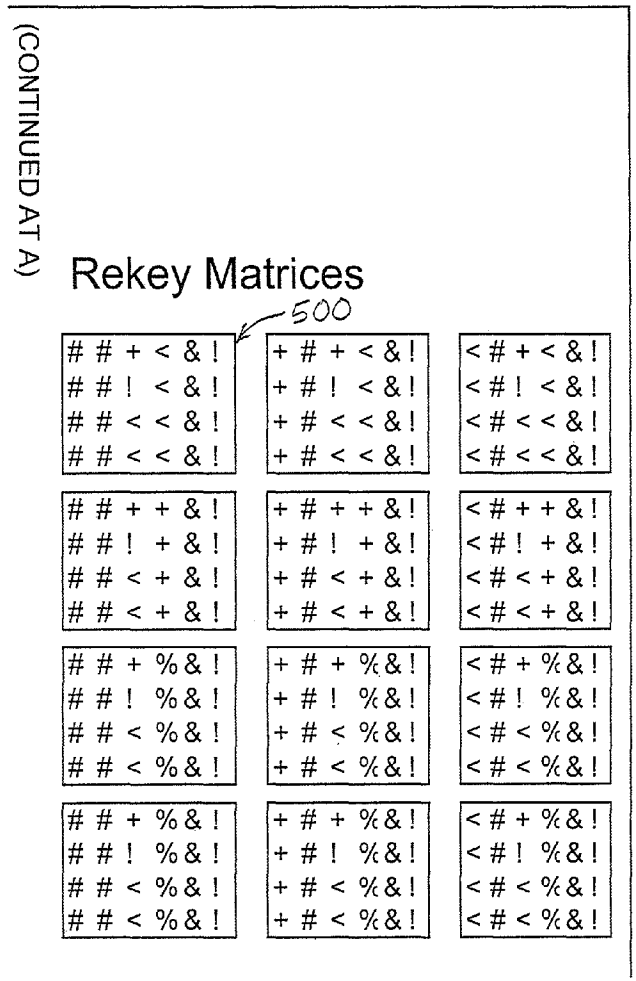
Figure 65C:
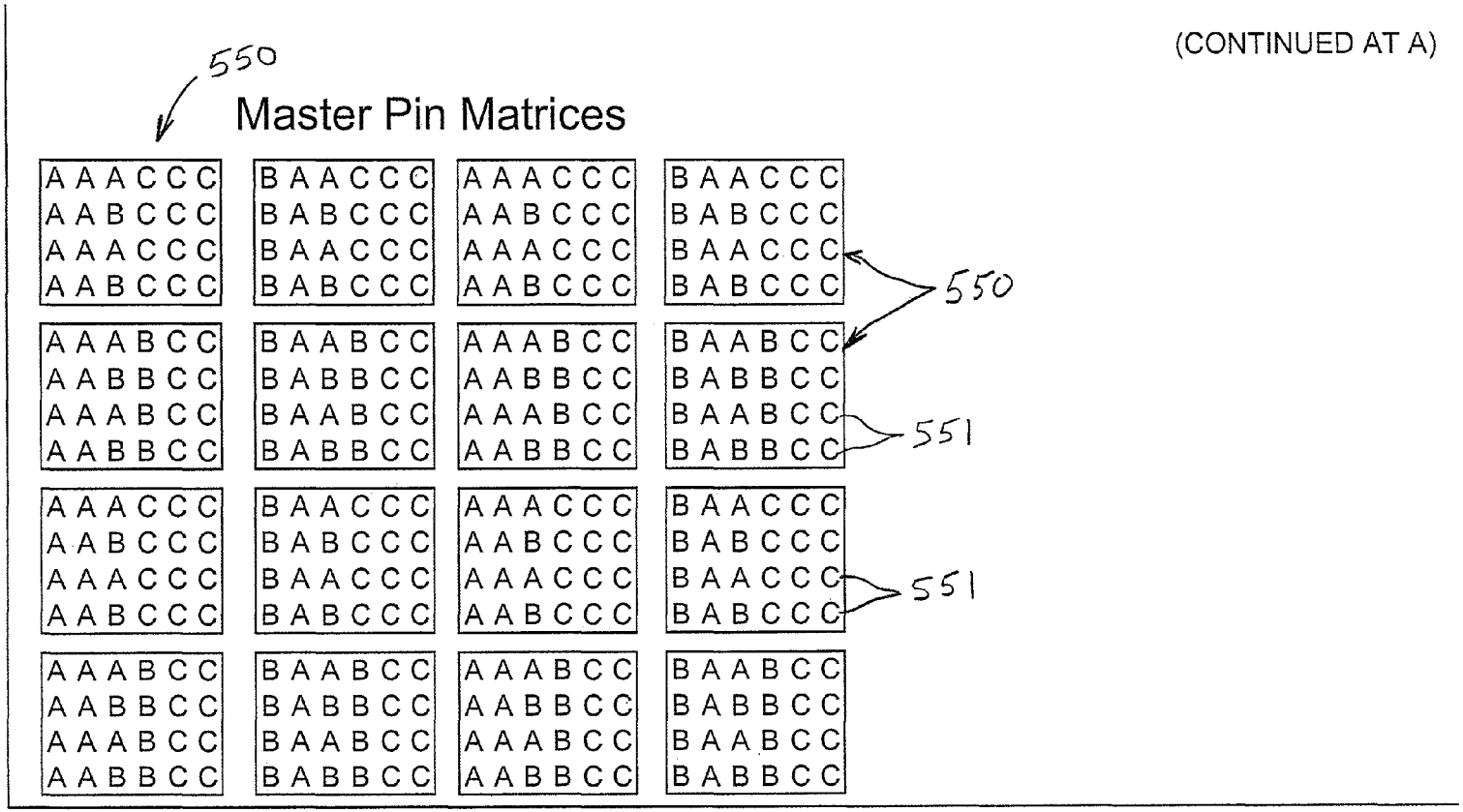

Once the KBA 430 has been entered, the bitting list generator calculates and outputs one or more arrays of all of the available key cuts and master key combinations using a standard progression format. For example, the standard progression format may list the available key cuts divided into segments known as blocks, horizontal groups, vertical groups, rows, and pages, as illustrated in FIG. 65, for levels of control. Other output means may alternatively be utilized and the invention is not limited to the illustrative page master described herein.

Referring to FIG. 65, an illustrative page master 450 for the KBA 430 of FIG. 64 is shown. The page master 450 includes each change key cut 451 that is available under the page master key cut 453. Additional master key cuts may also be available for the given page master 450. For example, there may be a master key cut 454 for each vertical group 452. In each vertical group 452 of this illustrated page master 450, twelve change key cuts 451 are available. This means that four cuts, as indicated by an *, in each of these groups 452 violates the MACS, and therefore, is identified as an unavailable change key cut. Additionally, a master key cut 456 is identified for each horizontal group 458. In the illustrated embodiment, each of the first three horizontal groups 458 has a respective master key cut 456, but the fourth horizontal group 458' does not have an available master key cut as indicated by the * next to the master key cut 456' which violates the MACS.

The page master 450 also shows higher level master key cuts, for example, a master key cut 455 that will operate all of the key cuts on page master 450 for page one as well as page masters 450 for pages two through four. Another master key cut 457 operates all of the key cuts on page master 450 for page one as well as page masters 450 for pages two through sixteen. A third master key cut 459, for the TMK, operates all of the key cuts on page master 450 for page one as well as page masters 450 for pages two through sixty-four. With this single page master 450, a user would be able to create a six level master key system with the change key cuts 451 as level 1, the vertical group and horizontal group master key cuts 454, 456 as level 2, the page master key cut 453 as level 3, the page one through four master key cut 455 as level 4, the page one through sixteen master key cut 457 as level 5, and the TMK master key cut 459 as level 6.

In addition to generating all of the change key cuts 451 and master key cuts 453, 454, 455, 456, 457 and 459, the generator calculates and displays a plurality of rekey matrices 500, each rekey matrix 500 corresponding to a block of change key cuts, and a plurality of master pin matrices 550, each master pin matrix 550 also corresponding to a block of change key cuts. Within each rekey matrix 500, a rekey cut 501 corresponds to a respective change key cut 451. Similarly, within each master pin matrix 550, a master pin sequence 551 corresponds to each change key cut 451.

The master pin sequence 551 represents which master pin should be positioned in each position of the cylinder assembly. For example, in the master keying system illustrated in FIGS. 64-70, three different master pins (A, B and C) are illustrated, however, other master pin configurations may be utilized. Additionally, the system is not limited to three distinct master pins, but may include less than or more than three master pin configurations.

Additionally, while the master key system described in the current example includes six master pins, the system is not limited to such and may include some non-master pins. The number of distinct master pins and percentage of master pins within a given cylinder assembly will determine the number of master key cuts available. The current KBA and the SOP are utilized with a cylinder having six master pins which are all used for master keying. Under such a system, the bitting list generator will generate sixty-four page masters 450. The number of page masters 450 will vary depending upon the set up of the cylinder and the configuration of the standard progression format. More or fewer page masters 450 may be generated as well as the particular number and arrangement of segments on each page master 450.

Figure 66:
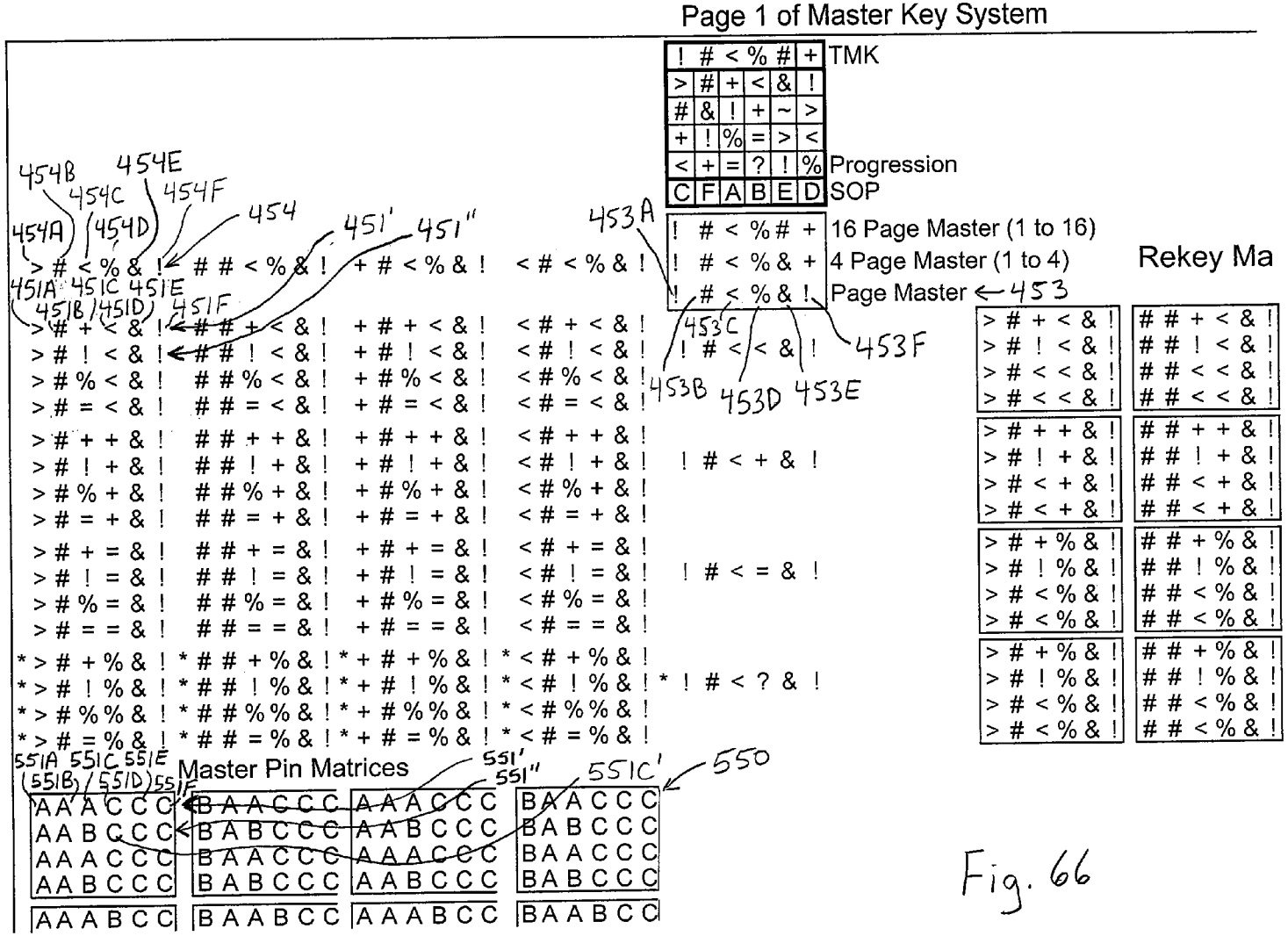
FIG. 66 is an expanded view of a portion of the page master of FIG. 65 illustrating the relationship of the master pin matrices.

To generate the master pin matrices 550, the system compares a given change key cut 451 to a corresponding master key cut. The master key cuts 453, 454, 455, 456, 457 and 459 are used for comparison as each master key cut 453, 454, 455, 456, 457 and 459 must be achievable with the given master sequence 551. Referring to FIG. 66, an example of the generation of two master sequences 551' and 551" is illustrated by comparing the respective change cuts 451', 451' to the vertical group master 454 and the page master 453. Examination of the remaining master key cuts 455, 456, 457 and 459 would show that each also is achievable with the master sequence 551.

Starting with change key cut 451', the first bitting 451A is compared to page master cut bitting 453A and differs thereto by N bites while first bitting 451A is the same as the vertical group bitting 454A. In the illustrated embodiment, the first master rack pin 551A is configured to work with bittings equal to or within N bite of change key bitting. As such, the first master pin 551A will be represented by an "A" in the master sequence 551'. Comparing the second bitting 451B to page master cut bitting 453B and vertical group bitting 454B, the bitting is the same for each, and therefore, the second master pin 551B will also be represented by an "A" in the master sequence 551'. The comparison is made for each of the bittings 451C-451F and an appropriate representation of each master pin 551C-551F in the master sequence 551' is determined. For master sequence 551', master pins 551A-551C is a master pin having only a N bite difference and is therefore represented by an "A" in each of these positions of the sequence 551' while master pins 551D-551F is a master pin having a P bite difference and is therefore represented by a "C" in each of these positions of the sequence 551'.

This comparison is done for each change key cut 451 to determine a master sequence 551 for each. Looking at the third bitting 451C' of change key cut 451", the bitting is O away from both the master cut bitting 453C and vertical group bitting 454C. In the illustrated embodiment, second master rack pin 551B is configured to work with bittings equal to or having a O bite difference with respect to the change key bitting. As such, the third master pin 551C' will be represented by a "B" in the master sequence 551".

Figure 67:
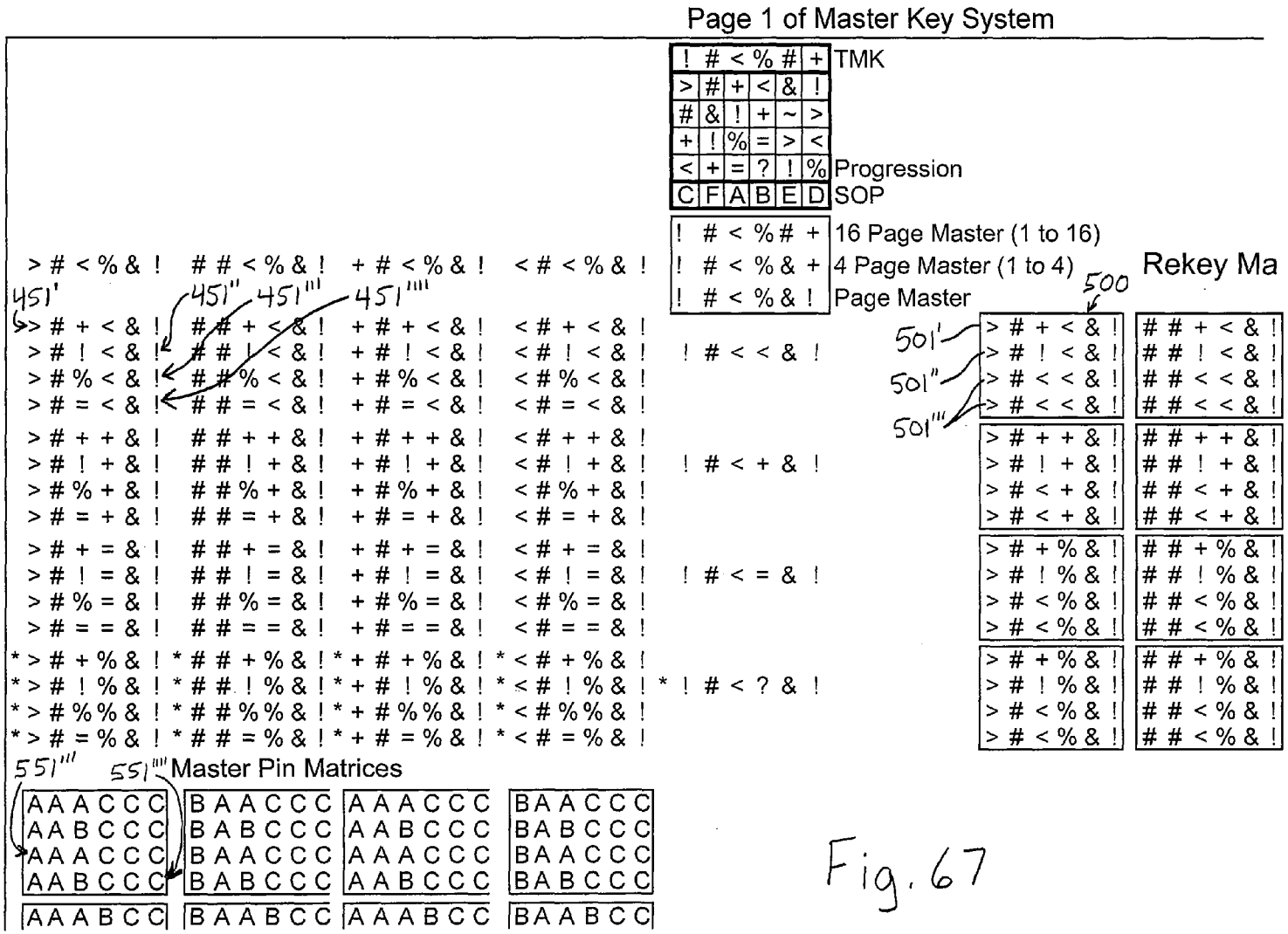
FIG. 67 is an expanded view of a portion of the page master of FIG. 65 illustrating the relationship of the rekey matrices.

The rekey matrices 550 represent the rekey cut 501 for each corresponding change key cut 451. The rekey matrices 550 may be established in a one-to-one manner such that each rekey cut 501 corresponds identically to the respective change key cut 451. However, knowing the master sequence 551 for each change key cut 451, the system of the present invention allows the number of rekeys to be minimized by using a single rekey cut 501 for multiple change key cuts. For example, as illustrated in FIG. 67, while rekey cut 501' corresponds identically to change key cut 451' and rekey cut 501" corresponds identically to change key cut 451", the rekey cut 501'" is configured to operate both change key cut 451'" and change key cut 451"". The system determines such by comparing the change key cuts 451'", 451"" with the respective master sequences 551'", 551"".

Figure 68:
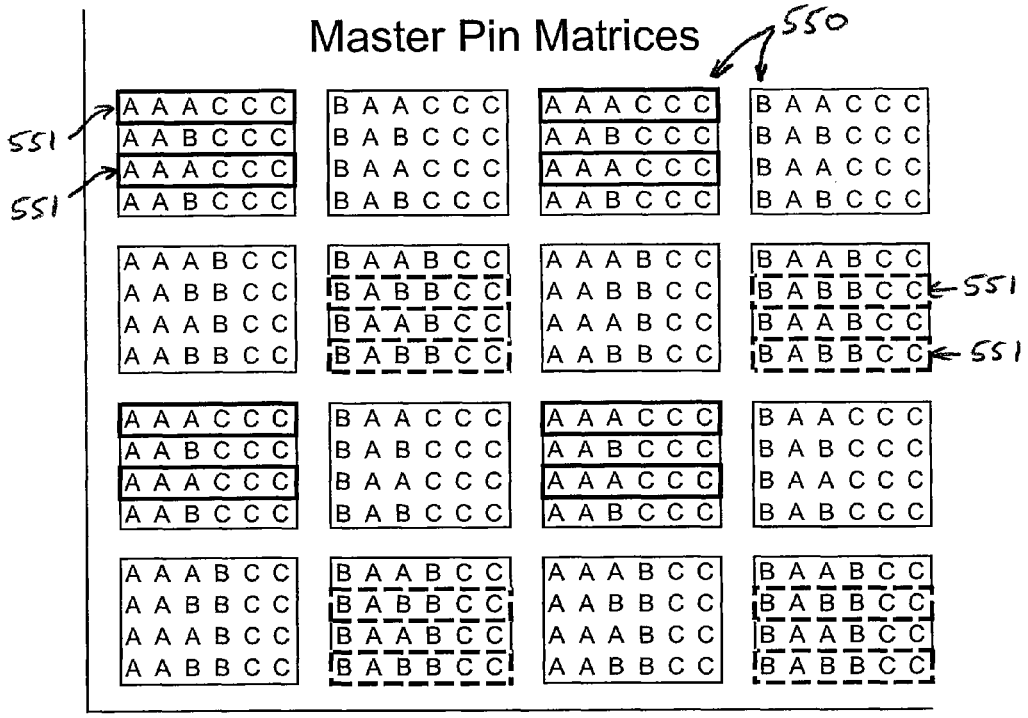
FIG. 68 is an expanded view of the master pin matrices of FIG. 65.
Figure 71A:
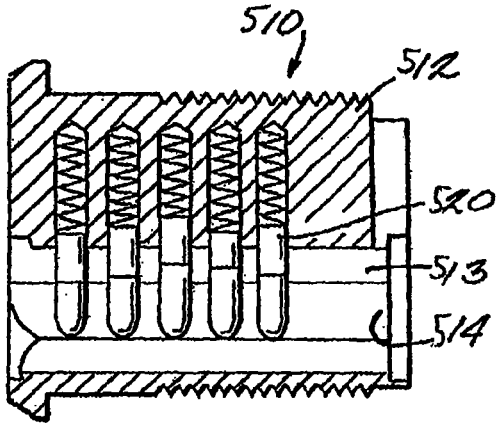
Fig.71A (Prior Art)
FIGS. 71A through 71C show a typical pin tumbler cylinder.
Figure 71B:
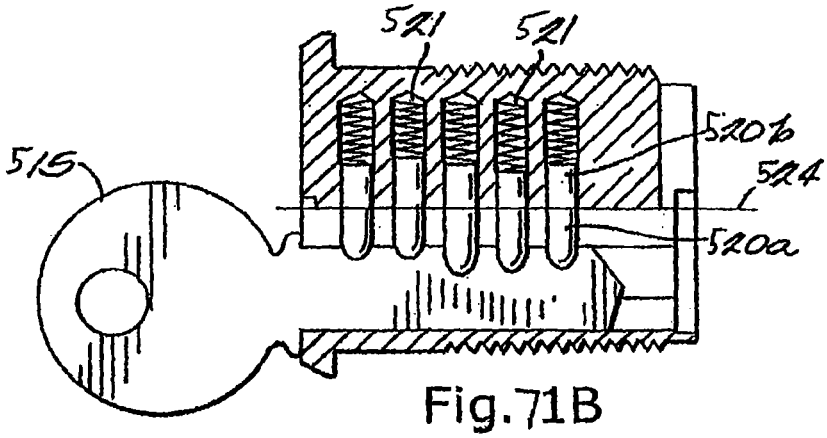
Fig.71B (Prior Art)
Figure 71C:
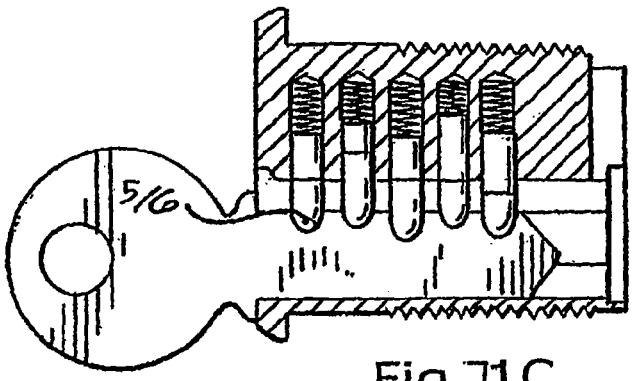
Fig.71C (Prior Art)
Figure 71D:
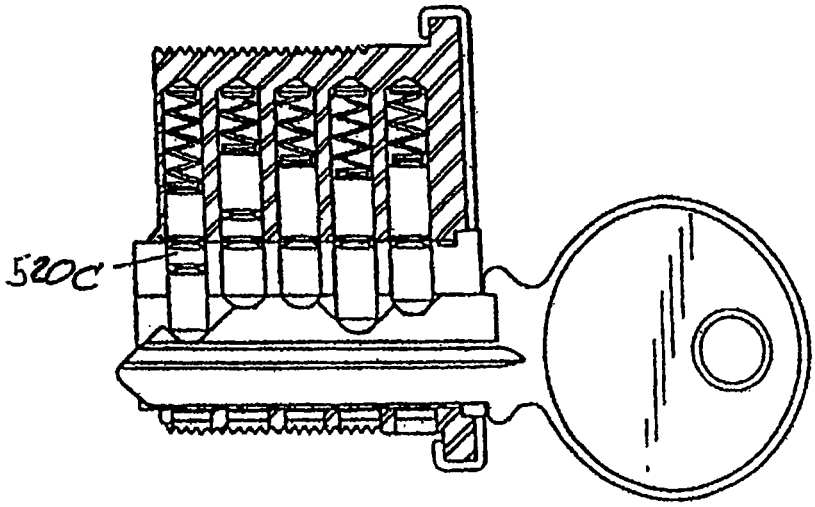
Fig.71D (Prior Art
FIGS. 71D and 71E show a typical master keyed pin tumbler cylinder.
Figure 71E:
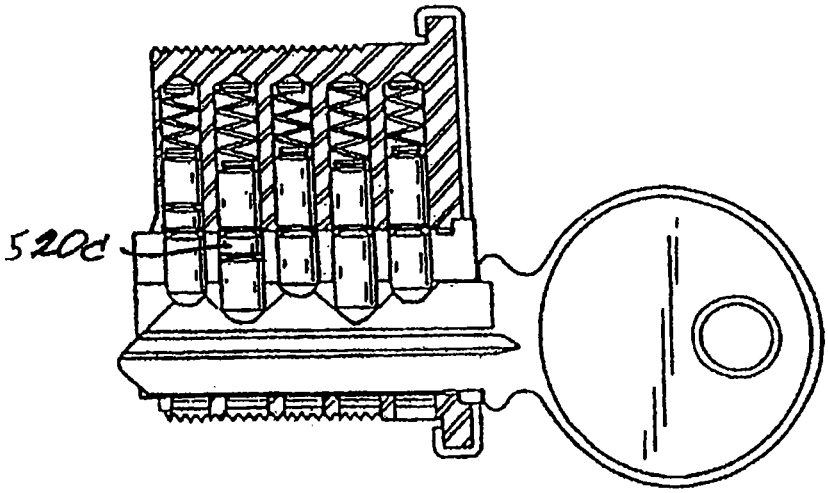
Fig.71E (Prior Art)

Referring to FIG. 68, it is seen that each master sequence 551 repeats multiple times within the master pin matrices 550. The number of times a given master sequence 551 repeats is dependent upon the KBA, the SOP, the number of master pins utilized and the number of distinct master pins. In the illustrated embodiment, each master sequence 551 repeats eight times on eight different pages of the master key system. On the illustration of page 1 of the master system, the master sequence 551 of A-A-A-C-C-C is repeated eight times as indicated by the solid line rectangles. Similarly, the master sequence 551 of B-A-B-B-C-C is repeated eight times as indicated by the dashed line rectangles. In this example, a similar eight times repeat of the A-A-A-C-C-C master sequence 551 is also found on 7 other pages of the master key system. As such, in the present system, the A-A-A-C-C-C master sequence 551 is repeated sixty-four times. Similarly, the master sequence 551 of B-A-B-B-C-C is repeated sixty-four times within the master key system.

As explained in more detail below, each repeat of a given master sequence 551 represents another change key cut 451 to which the cylinder assembly may be reprogrammed to without removing the cylinder assembly. This means that a given cylinder assembly under this master keying system can be changed sixty-three times from its original combination. Furthermore, since the repeats occur over different pages within the master keying system, a cylinder assembly can be rekeyed to a different master key hierarchy. For example, if a cylinder assembly is originally keyed to a change key cut on page 1 of the master key system, it would be part of the hierarchy including the vertical and horizontal group master keys, the page 1 master key, the page 1-4 master key, the page 1-16 master key and the TMK. If the cylinder is rekeyed to a change key cut having the same master sequence on page 43, the rekeyed cylinder would be part of the hierarchy including the new vertical and horizontal group master keys, the page 43 master key, the page 41-44 master key, the page 33-48 master key and the TMK.

Having explained generation of the illustrative page master 450, rekeying of a cylinder assembly having an initial change key cut 451X to a new change key cut will be explained with reference to FIGS. 69-70. First, the current change key cut 451X is identified within the master key system. The corresponding rekey cut 501X is identified in the rekey matrices 550. A reset key X having the rekey cut 501X is positioned in the lock cylinder and is rotated to a reset position as described above. The reset key X is removed from the cylinder and the cylinder assembly is ready for a new reset key Y to be inserted. In utilizing the system with other configurations of reprogrammable cylinders, other steps in the rekeying process may be carried out accordingly.

To identify the possible new change key cut, the master sequence 551X corresponding to change key cut 451X is identified. The cylinder assembly can be rekeyed to any change key cut having the same master sequence as master sequence 551X, namely, A-A-A-C-C-C. Referring to FIG. 70, a master sequence 551Y is identified within the same master pin matrix 550. Change to the corresponding change key cut 451Y allows the cylinder assembly to work with all of the same master key cuts. If maintaining the same master hierarchy is not desired, a different change key cut 451 with the master sequence 551 of A-A-A-C-C-C may alternatively be chosen.

Once the desired change key cut 451Y is identified, the corresponding rekey cut 501Y is identified from the rekey matrices 500. A reset key Y having the rekey cut 501Y, namely, >-#-%-<-&-!, is positioned in the lock cylinder and is rotated to the original cylinder position as described above. The reset key Y is removed from the cylinder and the cylinder assembly is reprogrammed for use with a key having the change key cut 501Y of >-#-%-<-&-!. In utilizing the system with other configurations of reprogrammable cylinders, other steps in the rekeying process may be carried out accordingly.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A programmable lock cylinder assembly comprising:

a lock housing having a body defining a tubular opening;

a cylinder plug having a body mounted for rotation within the tubular opening, the cylinder plug including a keyway extending therein;

a set of rack pins in the cylinder plug and moveable between a locked position wherein the cylinder plug is rotationally locked relative to the housing and an unlocked position wherein the cylinder plug is rotational relative to the housing, the set of rack pins includes at least a first subset of rack pins and a second subset of rack pins, the first subset of rack pins having at least two operable bitting configurations where one of the at least two bitting configurations of the first subset of rack pins is separated by a pre-determined number of bittings from the other of the at least two bitting configurations, and the second subset of rack pins having a different bitting configuration than the first subset of rack pins whereby the bitting configurations of the second subset of rack pins are separated by a different pre-determined number of bittings than the pre-determined number of bittings of the first subset of rack pins such that the lock cylinder assembly is master keyable, wherein each rack pin includes serrations and a notch formed in the serrations for receiving a locking sidebar, wherein a height dimension of the notch on the rack pins of the first subset of rack pins differs from the height dimension of the notch on the rack pins of the second subset of rack pins; and a re-combinating assembly within the cylinder plug configured to facilitate reprogramming of the rack pins without removing the rack pins from the cylinder plug.

2. The programmable lock cylinder assembly of claim 1 wherein the re-combinating assembly comprises: a set of tongue pins in the cylinder plug extending across the keyway, each tongue pin selectively engagable with a respective rack pin; and a re-combinating member engaged with the tongue pins and moveable between a first position wherein the tongue pins are engaged with the rack pins and a second position wherein the tongue pins are disengaged from the rack pins.

3. The programmable lock cylinder assembly of claim 1, wherein the bitting configuration of the second subset of rack pins includes a blocker that is configured to prevent engagement between the second subset of rack pins and the locking sidebar.

4. The programmable lock cylinder assembly of claim 3, wherein the bitting configuration of the first subset of rack pins does not include the blocker.

5. The programmable lock cylinder assembly of claim 3, wherein the second set of rack pins is configured to engage with the locking sidebar at a location that is at least partially above the blocker and another location that is below the blocker.

* * * * *